US009851669B2

(12) United States Patent
Moriya et al.

(10) Patent No.: US 9,851,669 B2
(45) Date of Patent: Dec. 26, 2017

(54) FIXING DEVICE

(71) Applicant: CANON KABUSHIKI KAISHA, Tokyo (JP)

(72) Inventors: Jiro Moriya, Numazu (JP); Hideki Ohta, Numazu (JP); Takayuki Mizuta, Numazu (JP); Naoto Tsuchihashi, Yokohama (JP); Eiji Uekawa, Susono (JP); Hiroshi Kataoka, Suntou-gun (JP); Keisuke Mochizuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 15/008,287

(22) Filed: Jan. 27, 2016

(65) Prior Publication Data

US 2016/0223971 A1 Aug. 4, 2016

(30) Foreign Application Priority Data

Jan. 29, 2015 (JP) ..... 2015-015749
Mar. 31, 2015 (JP) ..... 2015-074301

(51) Int. Cl.
*G03G 15/20* (2006.01)

(52) U.S. Cl.
CPC ..... *G03G 15/2064* (2013.01); *G03G 15/206* (2013.01); *G03G 2215/2035* (2013.01)

(58) Field of Classification Search
CPC ..... G03G 15/2089; G03G 15/2064; G03G 15/206
USPC ..... 399/328
See application file for complete search history.

(56) References Cited

U.S. PATENT DOCUMENTS

2002/0141796 A1* 10/2002 Nishitani ..... G03G 15/2064 399/328
2013/0302054 A1* 11/2013 Uehara ..... G03G 15/2064 399/67
2013/0322940 A1* 12/2013 Ichiki ..... G03G 15/2064 399/329

FOREIGN PATENT DOCUMENTS

JP 3501616 B2 3/2004

* cited by examiner

*Primary Examiner* — Sandra Brase
(74) *Attorney, Agent, or Firm* — Canon U.S.A., Inc. IP Division

(57) ABSTRACT

A fixing device includes first and second members, a frame supporting the second member, and two pressure mechanisms provided on either end of the first member. The mechanism includes a lever having one end supported by the frame in a rotatable manner in a pressure direction, and a helical compression spring disposed between a first spring support provided on the other end of the lever and a second spring support on the frame. At least one of the first and second spring supports includes a first area and a second area closer to the spring in the axial direction than the first area, the first area is in contact with an area of the spring close to a winding end of the spring, and the second area is in contact with an area of the spring farther away from the winding end in a winding direction than the first area.

13 Claims, 26 Drawing Sheets

FIXING DEVICE

BACKGROUND OF THE INVENTION

Field of the Invention

The present invention relates to a fixing device included in the image forming apparatus using electrophotographic technology.

Description of the Related Art

In general, fixing devices mounted in an image forming apparatus, such as a copying machine and a laser printer, convey a recording medium through a nip portion formed by a first fixing member and a second fixing member that are in pressure contact with each other and heat-fix an unfixed toner image onto the recording medium.

Among such fixing devices, some fixing devices include a pair of pressure mechanisms that urge both ends of the first fixing member against the second fixing member using the elastic force of a helical compression spring so that the first fixing member and the second fixing member to are in pressure contact with each other. To improve the pressure balance between the two pressure mechanism, a configuration that aligns the winding end positions of the helical compression springs disposed at both ends has been developed (refer to Japanese Patent No 3501616). However, the fixing device described in Japanese Patent No. 3501616 has the following issues. That is, by aligning the positions of the winding ends of the helical compression springs, the pressures at both the ends of the fixing member are forced to be the same. In such a technology, since at the ends of the helical compression spring, the protrusion level of the spring winding end of the coil in the axial direction of the coil is the highest, the portions in the vicinity of the spring winding ends receive a large reaction force from spring supporting portions, as indicated by outlined arrows illustrated in FIG. 11. Each of arrows in FIG. 11 indicates the magnitude of a reaction force received by a helical compression spring 87 from a spring support member (the length of the arrow) and the direction of the reaction force (the direction of the arrow). According to the fixing device described in Japanese Patent No. 3501616, the helical compression spring 87 receives reaction forces F11 and F12 in one of two spring support areas thereof in the cross section that passes through an axial line 87*s* of the helical compression spring 87 and reaction forces F13 and F14 in the other spring support area. The reaction force F11 in the vicinity of the spring winding end is larger than the reaction force F12. The reaction force F14 in the vicinity of the spring winding end is larger than the reaction force F13. Accordingly, the helical compression spring 87 does not receive a uniform reaction force from the supporting portion. Consequently, a force that rotates the helical compression spring 87 is easily generated. As a result, the direction of action of a force Fs of the helical compression spring 87 is inclined from the direction of a pressure Ft applied in the nip portion and, thus, loss of the pressure applied in the nip portion easily occurs.

In addition, a configuration that corrects the balance between the reaction forces exerted on a helical compression spring by cutting and grinding the spring terminals has been developed. However, if the helical compression spring having cut and ground spring ends is employed in fixing devices, the cost increases. In addition, the following issue arises. That is, the helical compression spring having cut and ground spring ends has a small thickness of the coil in the vicinity of the winding end and, thus, the rigidity easily decreases. If a high load is imposed on the thin coil portion, the spring deforms. As a result, the pressure in the nip portion decreases.

SUMMARY OF THE INVENTION

According to an aspect of the present invention, a fixing device for fixing a toner image onto a recording medium by conveying and heating the recording medium on which the toner image is formed at a nip portion is provided. The fixing device includes a first fixing member, a second fixing member configured to form the nip portion together with the first fixing member, a frame configured to support the second fixing member, and a pair of pressure mechanisms provided on either end of the first fax member in a longitudinal direction of the first fixing member. The pressure mechanisms urge the first fixing member against the second fixing member. Each of the pressure mechanisms includes a lever having one end supported by the frame in a rotatable manner in a pressure direction in which the first fixing member is urged and a helical compression spring disposed between a first spring support portion provided on the other end of the lever and a second spring support portion provided on the frame. The pressure mechanism urges the first fixing member against the second fixing member via the lever by an elastic force of the spring. At least one of the first spring supporting portion and the second spring supporting portion includes a first supporting area and a second supporting area closer to the spring in an axial direction of the spring than the first supporting area, the first supporting area is in contact with an area of the spring close to a winding end of the spring, and the second supporting area is in contact with an area of the spring farther away from the winding end in a winding direction of the spring than the first supporting area.

Further features of the present invention will become apparent from the following description of exemplary embodiments with reference to the attached drawings.

DESCRIPTION OF THE EMBODIMENTS

First Exemplary Embodiment

Figure 1A:
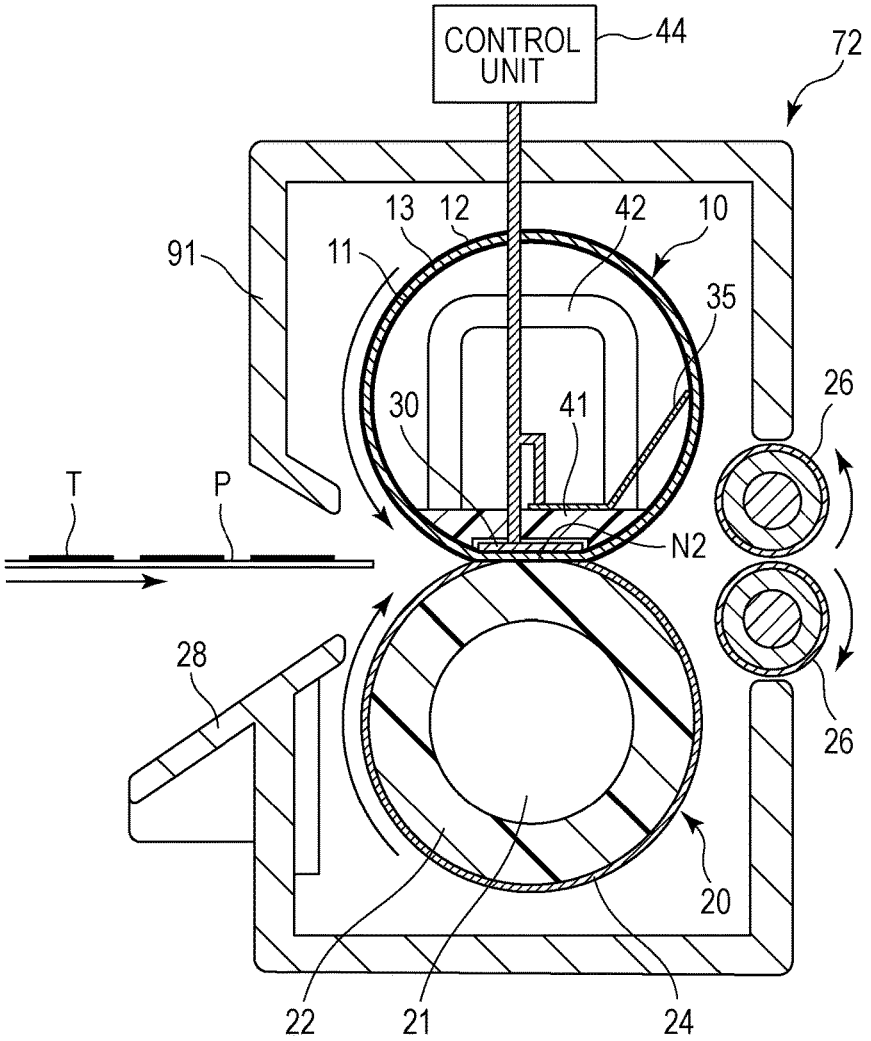
FIGS. 1A and 1B are transverse sectional views of a fixing device according to a first exemplary embodiment.
Figure 1B:
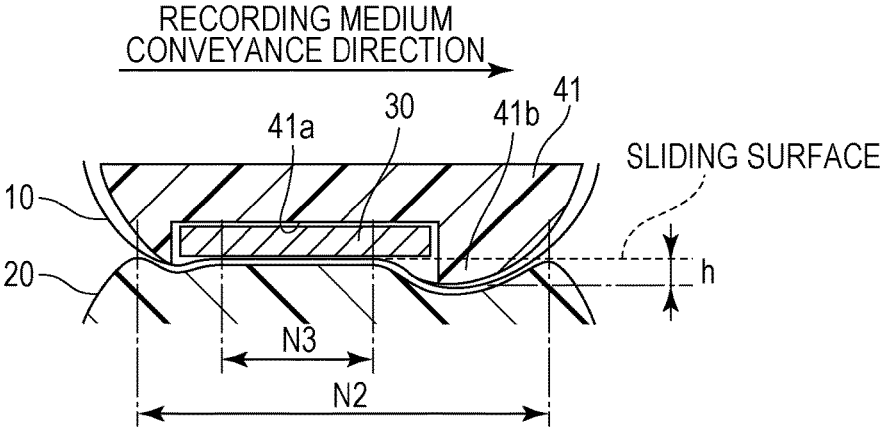
Figure 2A:
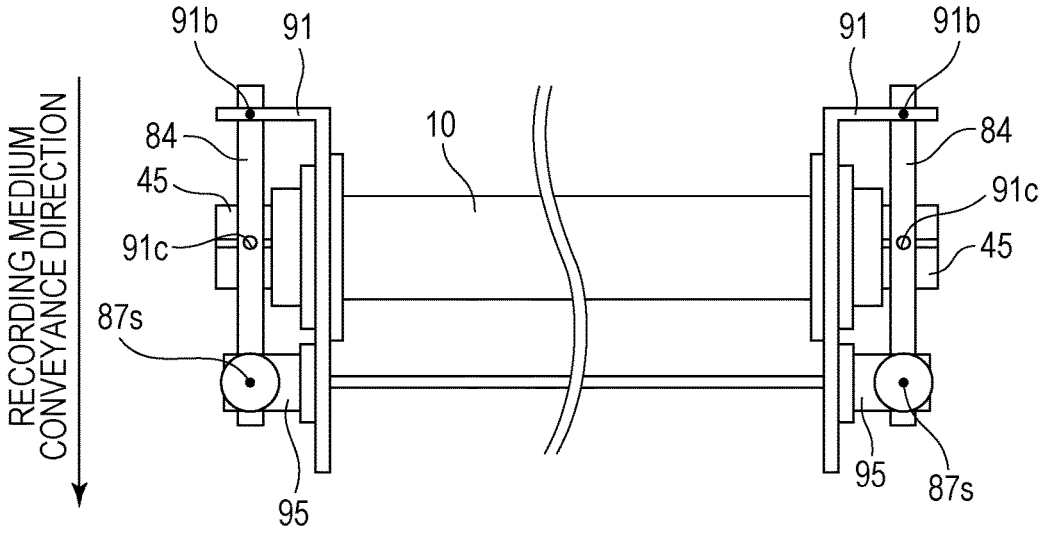
FIGS. 2A and 2B are schematic illustrations of the fixing device according to the first exemplary embodiment.
Figure 2B:
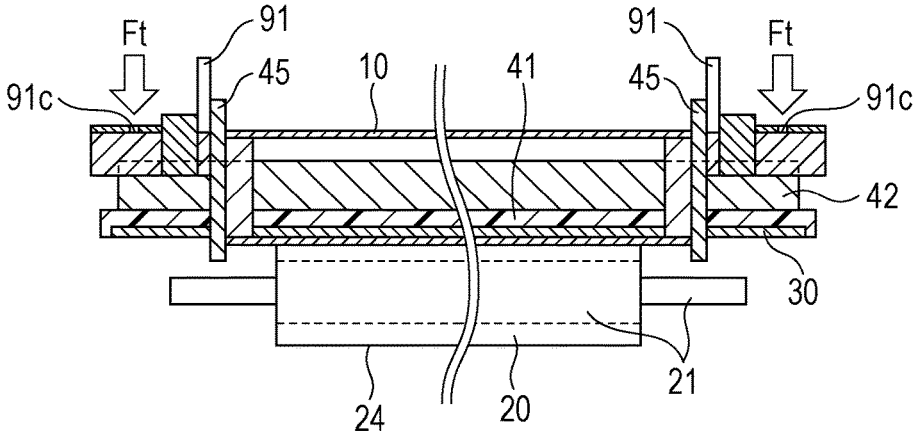

A fixing device 72 according to the present exemplary embodiment is described below with reference to FIGS. 1A and 1B and FIGS. 2A and 2B. Note that in the following description, the term "longitudinal direction" of a member that constitutes the fixing device refers to a direction perpendicular to the recording medium conveyance direction. FIG. 1A is a schematic cross-sectional view of the fixing device 72 viewed in the longitudinal direction. FIG. 1B is an enlarged view of a nip portion of the fixing device 72. FIG. 2A is a schematic illustration of the fixing device 72 when viewed from a film 10 side in the fixing device. FIG. 2B is a schematic illustration of the fixing device 72 when viewed from the downstream side in a recording medium conveyance direction.

According to the present exemplary embodiment, the fixing device 72 includes a cylindrical film 10, a heater 30 in contact with the inner peripheral surface of the film 10, and a pressure roller 20. The heater 30 forms a fixing nip portion N2 together with the pressure roller 20 via the film 10. The fixing device 72 conveys, in the fixing nip portion N2, a recording medium having a toner image formed thereon and, simultaneously, heats the toner image. Thus, the toner image is fixed onto the recording medium. The fixing device 72 further includes a heater holder 41 that supports the heater 30, a pressure stay 42 that increases the bending rigidity, and a fixing flange 45 serving as a regulating member that regulates the movement of the film 10 in the longitudinal direction.

The film 10, the heater 30, the heater holder 41, the pressure stay 42, and the fixing flange 45 are integrated into a film unit (a first fixing member). According to the present exemplary embodiment, the fixing device 72 is configured to urge the film unit against the pressure roller 20 (a second fixing member).

The film 10 includes a base layer 11 and the release layer 12 provided on the outer surface of the base layer 11. In addition, to increase fixability, an elastic layer 13 formed of, for example, silicone rubber may be disposed between the base layer 11 and the release layer 12. If the elastic layer 13 is provided, an unfixed toner image T borne by a recording medium P can be encompassed and, thus, the heat can be uniformly provided to the toner image. It is desirable that the thickness of the elastic layer 13 be 50 μm and greater and 500 μm or less in order to reduce the warm-up time. The base layer 11 can be generated by forming a thin-wall metal having a high thermal conductivity, such as SUS or Ni, or a heat resistant resin, such as polyimide resin, a polyamide-imide resin, or PEEK, into a thin-wall flexible continuous belt. To form the release layer 12, a fluorine contained resin, such as PFA, PTFE, FEP, or a mixture thereof, is coated on the outer surface of the base layer 11. Alternatively, the outer surface of the base layer 11 is covered by a tube made of the above-described resin. To increase the durability of the release layer 12, it is desirable that the thickness of the release layer 12 be 5 μm and greater. In addition, if the release layer 12 is too thick, the thermal conductivity decreases and, thus, the fixability decreases. Accordingly, it is desirable that the thickness of the release layer 12 be 50 μm and less.

The heater holder 41 is made of liquid crystal polymer, a phenol resin, PPS, or PEEK. The heater holder 41 is formed so as to have a transverse section in the shape of a half-moon gutter. The lower surface of the heater holder 41 (a surface adjacent to the pressure roller 20) has a groove 41*a* having a recess shape formed along the longitudinal direction of the heater holder 41. The heater 30 is supported by the groove 41*a*. The film 10 is loosely fitted onto the outer periphery of the heater holder 41. Both ends of the heater holder 41 having the loosely fitting film 10 are supported by both ends of a frame 91 via the fixing flanges 45. As illustrated in FIG. 1B, the heater holder 41 includes a protrusion 41*b* on the downstream side in the recording medium conveyance direction. In the fixing nip portion N2, the protrusion 41*b* extends in the longitudinal direction along a portion of the heater holder 41 in contact with the inner peripheral surface of the film 10. The protrusion 41*b* protrudes from a sliding surface of the heater 30 that slides or the film 10 toward the outer surface of the film 10 by a protrusion amount h. The protrusion 41*b* is disposed so as to be located at the same position in the recording medium conveyance direction throughout its length. According to the fixing device of the present exemplary embodiment, the protrusion amount h is set to 0.2 mm. As illustrated in FIG. 1B, a contact portion is divided into two contact portions, that is, a contact portion of the film 10 and the heater 30 and a contact portion of the film 10 and the heater holder 41. As used herein, the term "sliding surface" refers to the contact portion between the film 10 and the heater 30.

As illustrated in FIG. 1A, the pressure roller 20 includes a core shaft portion 21, an elastic layer 22 disposed on the outer surface of the core shaft portion 21, and a release layer 24 disposed on the outer surface of the elastic layer 22. The elastic layer 22 can be formed of, for example, silicone rubber or fluorine-contained rubber. To form the release layer 24, a fluorine contained resin, such as PEA, PTFE, FEP, or a mixture thereof, is coated. Alternatively, a tube made of the above-described resin is used as the release layer 24. According to the present exemplary embodiment, the core shaft portion 21 is formed from an iron core shaft having ϕ22, and the elastic layer 22 is formed of the silicone rubber having a thickness of 4 mm. The release layer 24 is formed from a PFA tube having a thickness of 50 μm.

The heater 30 is in contact with the inner peripheral surface of the film 10 and heats the film 10. The heater 30 includes an elongated substrate extending in the longitudinal direction. The substrate can be formed as a ceramic (e.g., alumina or aluminum nitride) substrate or a heat resistant resin (e.g., polyimide, PPS, or liquid crystal polymer) substrate. The substrate has a heating resistor layer on the back surface thereof (a surface remote from the pressure roller 20) along the longitudinal direction of the substrate. The beating resistor layer is applied to the substrate in a band-like shape. The heating resistor layer is formed of, for example, Ag/Pd (silver-palladium), $RuO_2$, or $Ta_2N$. In addition, the substrate has glass coat on the back surface thereof in order to protect the heating resistor layer and ensure electrical insulation. Furthermore, the substrate has a sliding layer on a surface thereof that is in contact with the inner peripheral surface of the film 10 in order to increase the slidability. The sliding layer is formed of, for example, a heat resistant resin (e.g., a polyimide or polyamide-imide resin) or glass coat. According to the present exemplary embodiment, the size of the substrate of the heater 30 is 350 mm in the longitudinal direction, 10 mm in the short direction, and 0.6 mm in the thickness direction.

The pressure stay 42 is formed into a U shape using a material having rigidity (e.g., a metal). The pressure stay 42 is disposed on the upper surface of the heater holder 41 (a surface distant from the pressure roller 20) inside the film 10. The pressure stay 42 urges both ends of the pressure stay 42 in the longitudinal direction toward the axial line of the pressure roller 20 via the fixing flange 45 supported by the frame 91. Thus, the heater 30 is urged against the surface of the pressure roller 20 via the film 10, and an inner nip N3 having a predetermined width is formed between the heater 30 and the film 10. In addition, a fixing nip N2 having a predetermined width is formed between the film 10 and the pressure roller 20. Heat necessary for the heat fixing of the unfixed toner image T is transferred from the heater 30 to the film 10 in the inner nip N3, and the heat is transferred from the film 10 to the recording medium P in the fixing nip N2. At that time, the recording medium is conveyed.

Upon receiving a print instruction, a control unit 44 drives a motor serving as a driving source to rotate a drive gear disposed at an end of the core shaft portion 21 of the pressure roller 20 in the longitudinal direction. Thus, the pressure roller 20 rotates at a predetermined circumferential velocity in a direction of an arrow. At that time, a rotary force that attempts to rotate the film 10 in a direction opposite to the rotational direction of the pressure roller 20 is exerted on the film 10 due to a frictional force generated between the surface of the pressure roller 20 and the surface of the film 10 in the fixing nip N2. In this manner, the film 10 is driven to rotate in the direction of the arrow at a circumferential velocity that is substantially the same as that of the pressure roller 20 outside the heater holder 41 with the inner peripheral surface of the film 10 in contact with the sliding layer of the heater 30.

Figure 3:
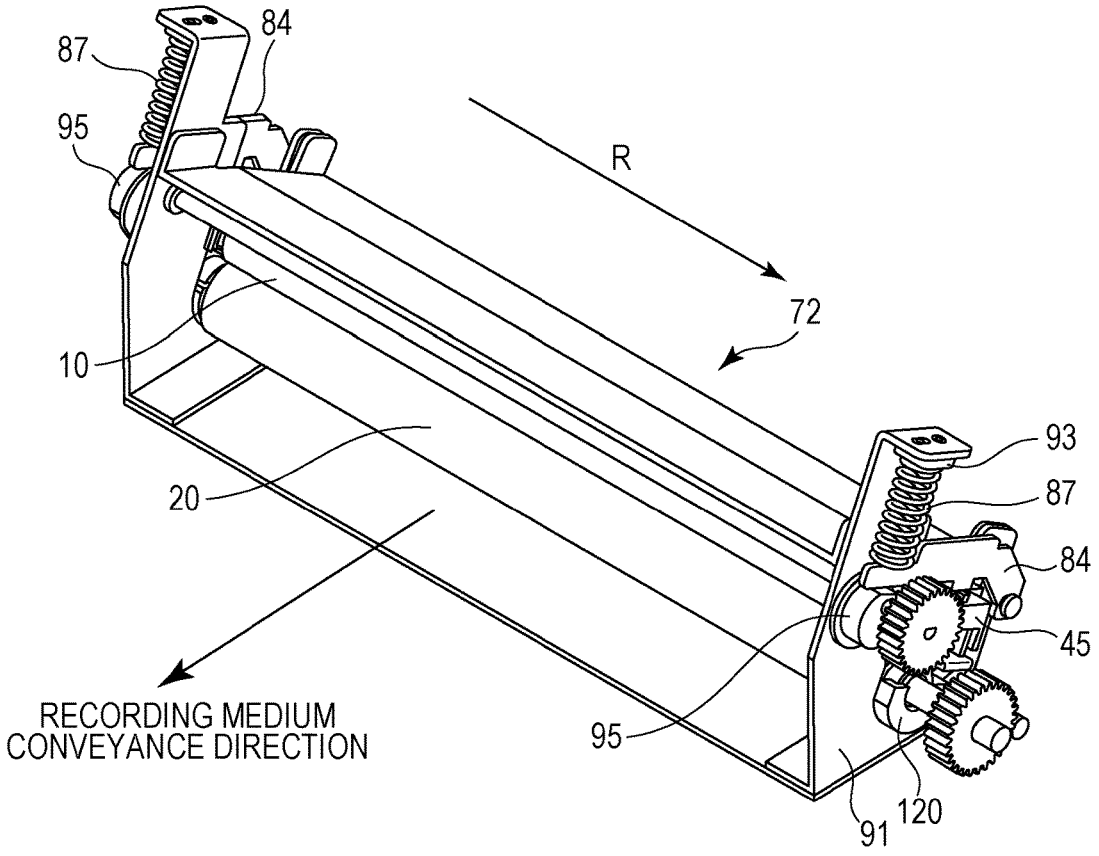
FIG. 3 is a schematic perspective view of the fixing device according to the first exemplary embodiment.
Figure 4:
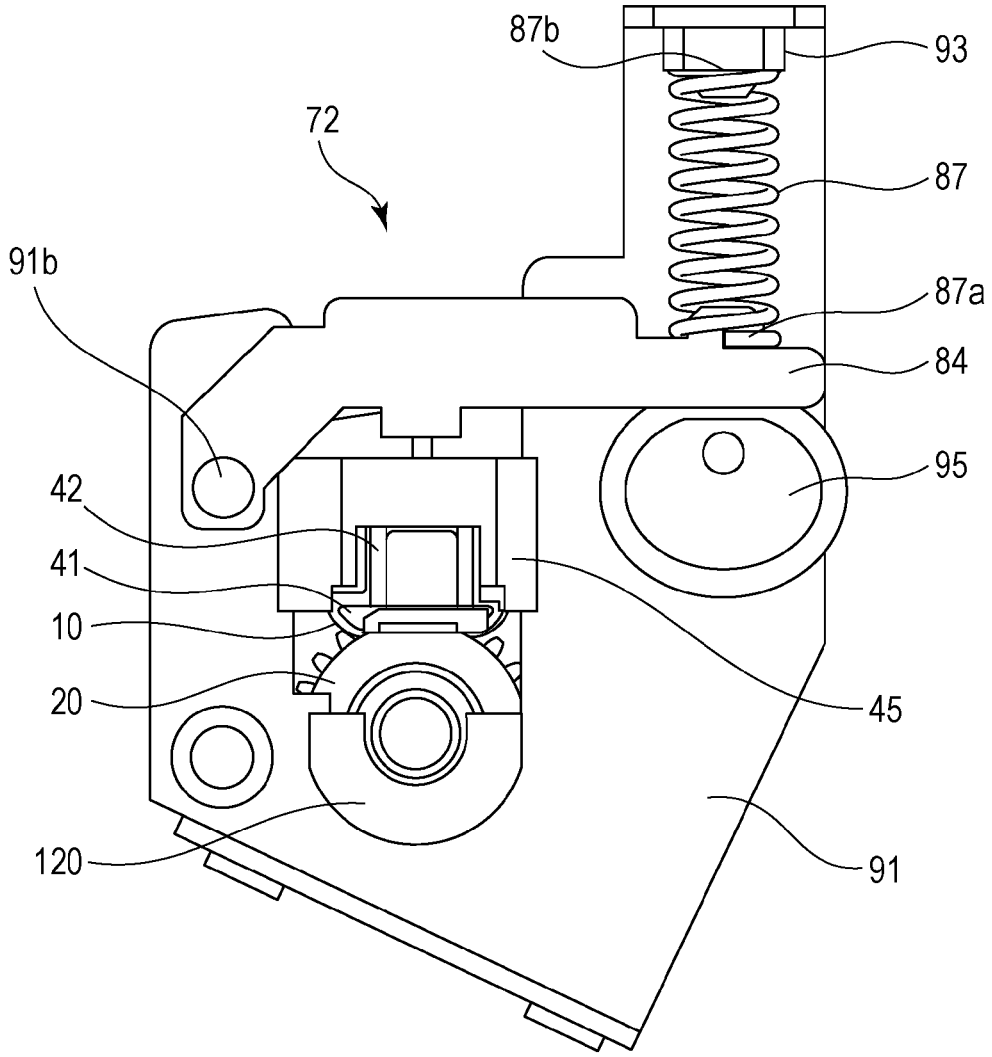
FIG. 4 is a schematic side view of the fixing device according to the first exemplary embodiment.

A thermistor 35 serving as a temperature detecting unit detects the temperature of the film 10 and outputs a temperature detection signal to the control unit 44. The thermistor 35 is disposed so as to be capable of detecting the temperature of an area through which the recording medium P having any of all the sizes allowable for the fixing device 72 passes. The control unit 44 receives the temperature detection signal from the thermistor 35 and controls the power supplied to the heating resistor layer on the basis of the temperature detection signal so that the film 10 has a predetermined target temperature. In this manner, the recording medium P having the unfixed toner image T thereon is led to the fixing nip N2 along an entry guide 28 with the temperature of the film 10 maintained at the predetermined target temperature. Thereafter, the recording medium P is pinched by the film 10 and the pressure roller 20 and is conveyed. In the conveyance stage, the heat of the film 10 heated by the heater 30 and the pressure from the fax nip N2 are applied to the recording medium P. Due to the heat and pressure, the unfixed toner image T is fixed onto the surface of the recording medium P. After passing through the fixing nip N2, the recording medium P is separated from the film 10 by self stripping and is elected by the conveyance roller 26. The pressure mechanism according to the present exemplary embodiment is described below with reference to FIGS. 3 and 4. FIG. 3 is a perspective view of the fixing device 72. FIG. 4 is a side view of the fixing device 72 viewed in a direction of an arrow R in FIG. 3. The pressure roller 20 is rotatably supported by a frame 91 disposed at both ends of the pressure roller 20 in the longitudinal direction via bearings 120. A guide portion 91*a* that regulates the direction in which the film unit is pressed is disposed on the frame 91.

Each of a pair of the pressure mechanisms includes a lever 84, a turning center 91*b* of the lever 84 and a spring support portion 93 (a second spring support portion) provided in the frame 91, and a helical compression spring 87. The pressure mechanisms are provided at either end of the film 10 in the longitudinal direction.

The lever 84 is a member having one end supported by the turning center 91*b* in the frame 91 in a rotatable manner in a direction in which the film 10 is pressed.

The helical compression spring 87 is disposed and compressed between a spring support portion 840 (a first spring support portion) provided at the other end of the lever 84 and a spring support portion 93 of the frame 91. The other end of the lever 84 supports a lower end 87*a* of the helical compression spring 87. In contrast, the spring support portion 93 is provided in the frame 91 and supports an upper end 87*b* of the helical compression spring 87. The spring support portion 93 has a function of regulating the height of the helical compression spring 87 so that the pressure of the helical compression spring 87 is maintained at a predetermined pressure (a specified load). According to the present exemplary embodiment, the helical compression spring 87 has a free height of 35 mm and a specified height of 27 mm upon pressurization. The lever 84 can rotate about the turning center 91*b* due to the elastic force of the helical compression spring 87 and exerts a pressure Ft on the fixing flange 45 via the lever 84. Thus, the lever 84 can urge the film unit against the pressure roller 20. Note that by moving the lever 84 in a direction in which the helical compression spring 87 is compressed using a cam member 95, the pressure applied in the fixing nip N2 can be released.

Figure 5A:
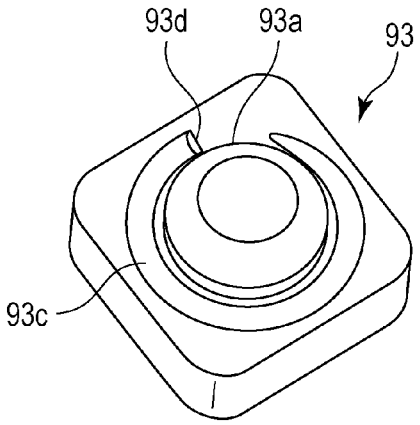
FIGS. 5A to 5C are schematic perspective views and cross sectional views of a spring support member of the fixing device according to the first exemplary embodiment.
Figure 5B:
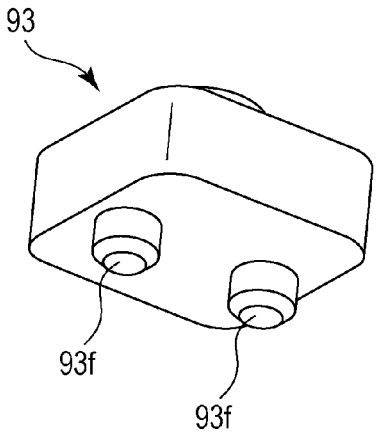
Figure 5C:
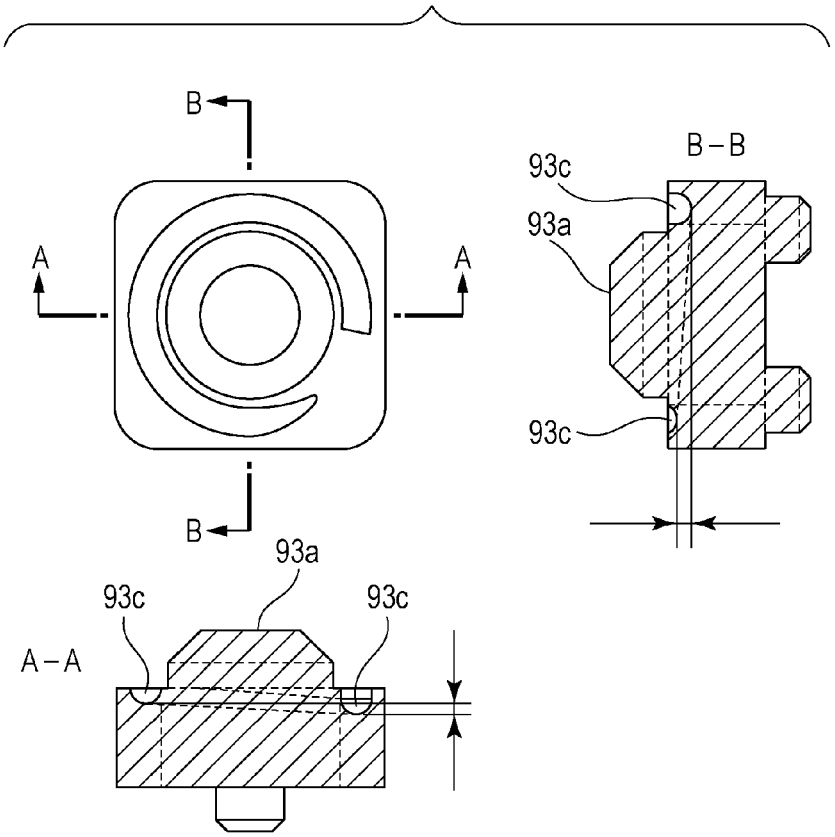

The spring supporting portion according to the present exemplary embodiment is described below with reference to FIG. 4. The helical compression spring 87 is wound in a right hand direction. The number of effective turns of the helical compression spring 87 is 10. The helical compression spring 87 is a closed-end spring. The helical compression spring 87 is compressed and supported between the spring support portion 93 to which the helical compression spring 87 is fixed and the spring support portion 840 of the lever 84. FIGS. 5A and 5B are external perspective views of the spring support portion 93. As illustrated in FIG. 5B, a mounting surface of the spring support portion 93 that is mounted on the frame 91 has positioning pins 93*f* formed therein. Each of the positioning pins 93*f* is aligned with a mounting hole 91*c* of the frame 91. Thus, the spring support portion 93 is mounted on the frame 91 in place. As illustrated in FIG. 5A, a spring support surface of the spring support portion 93 has a groove 93*c* formed therein around a cylindrical portion 93*a*. A front end portion of the groove 93*c* includes a flat portion 93*d* that receives a spring winding end 87*c* (refer to FIG. 6) of the helical compression spring 87 mounted thereon. As illustrated in FIG. 5C, the depth of the groove 93*c* gradually decreases in a direction away from the flat portion 93*d*.

Figure 6:
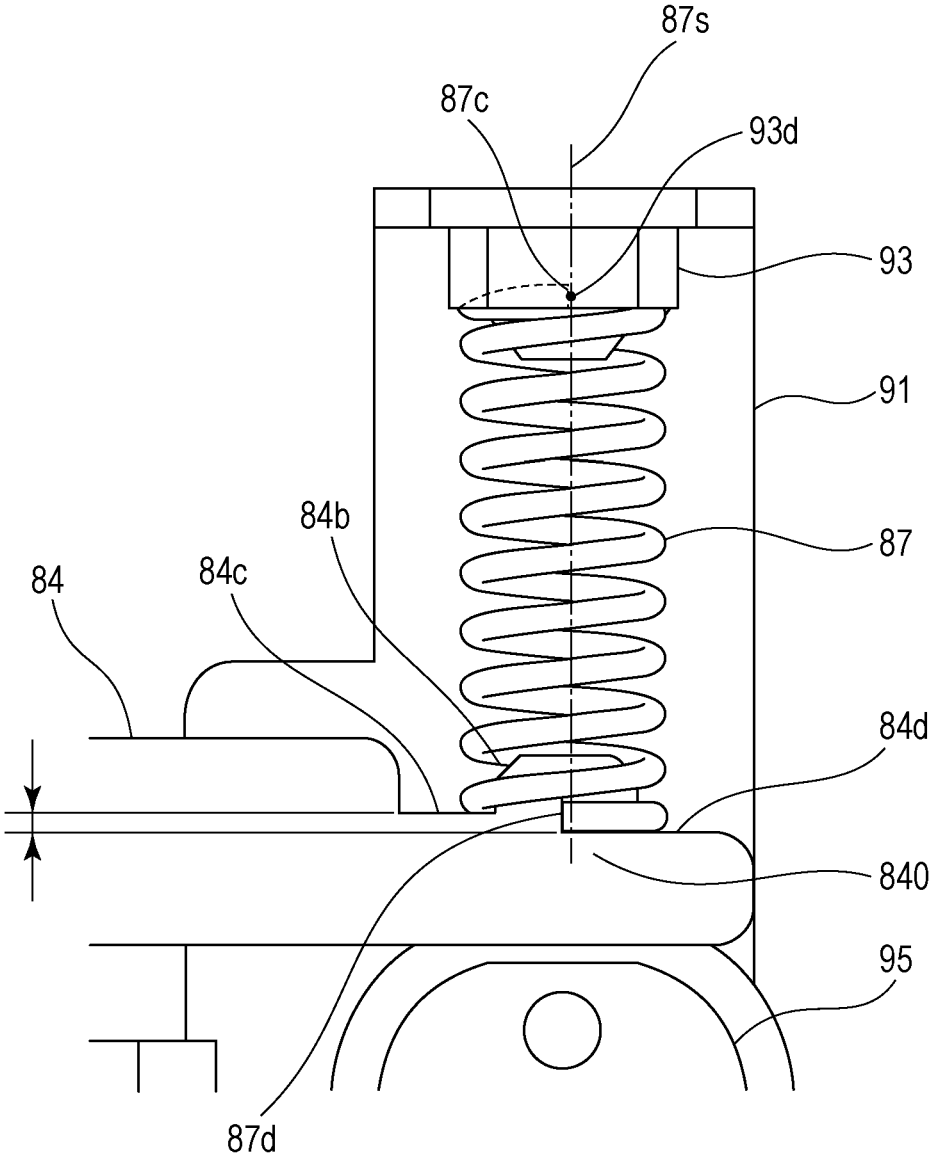
FIG. 6 is a schematic side view of the fixing device according to the first exemplary embodiment.

FIG. 6 is an enlarged side view of the supporting portion of the helical compression spring 87 of the fixing device 72. The lever 84 is a plate member (a plate). An edge portion of the lever 84 has a convex portion 84*b* that is inserted into an inner-diameter portion of the helical compression spring 87 and a spring support area 84*c* (a second spring support area) and a spring support area 84*d* (a first spring support area) formed on either side of the convex portion 84*b*. When viewed in the axial direction of the helical compression spring 87, the spring support area 84*c* and the spring support area 84*d* are disposed so as to be symmetrical with respect to the axial center of the helical compression spring 87. The spring support area 84*d* that is further away from the turning center 91*b* of the lever 84 is located at a height which is stepped down from the spring support area 84*c*, in terms of a plane perpendicular to the axial line 87*s* of the mounted helical compression spring. That is, the spring support area 84*d* is offset from the spring support area 84*c* in the axial direction of the helical compression spring 87 away from the helical compression spring 87.

Figure 7A:
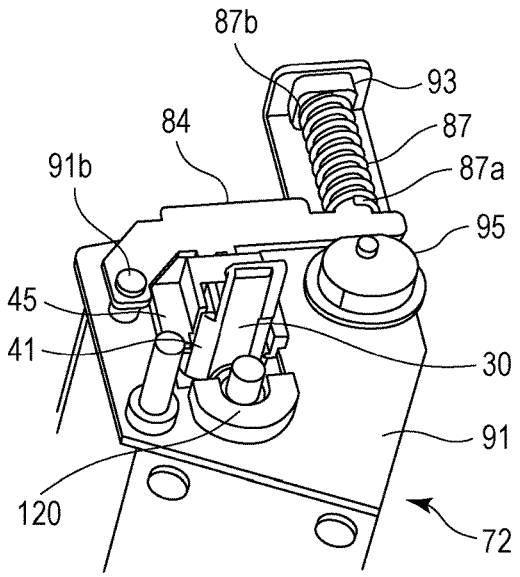
FIGS. 7A to 7D are a schematic perspective view of the fixing device and schematic illustrations of a spring and the spring support member according to the first exemplary embodiment.
Figure 7B:
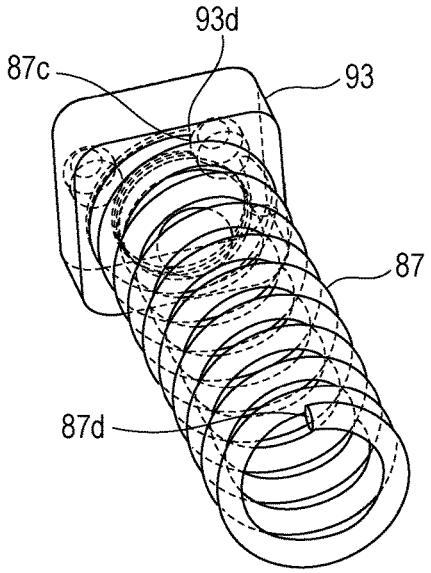
Figure 7C:
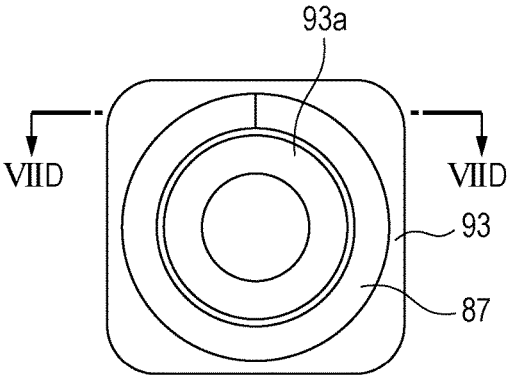
Figure 7D:
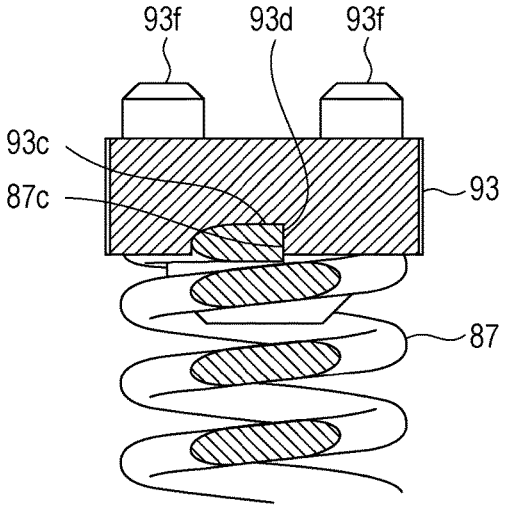

FIG. 7A is an external perspective view of the fixing device 72 when viewed from below at an angle. FIGS. 7B, 7C, and 7D illustrate only the helical compression spring 87 and the spring support portion 93 assembled together. As illustrated in FIGS. 7B, 7C, and 7D, at the upper end 87*b* of the helical compression spring 87, the spring winding end 87*c* is brought into contact with the flat portion 93*d* of the spring support portion 93 and, thus, the position of the upper end 87*b* of the helical compression spring 87 in the rotational direction about the axial line of the helical compression spring 87 is regulated. The coil portion extending from the spring winding end 87*c* is supported by the groove 93*c* of the spring support portion 93. As illustrated in FIG. 7C, since the number of effective turns of the spring is an integer, the other spring winding end 87*d* supported by the lever 84 is located beneath the spring winding end 87*c*. At the lower end 87*a* of the helical compression spring 87, a portion close to the spring winding end 87*d* in the winding direction of the helical compression spring 87 is in contact with the spring support area 84*d* of the lever 84 and, thus, is supported by the spring support area 84*d*, and a portion distant from the spring winding end 87*d* is in contact with the spring support area 84*c* and, thus, is supported by the spring support area 84*c*.

Figure 8:
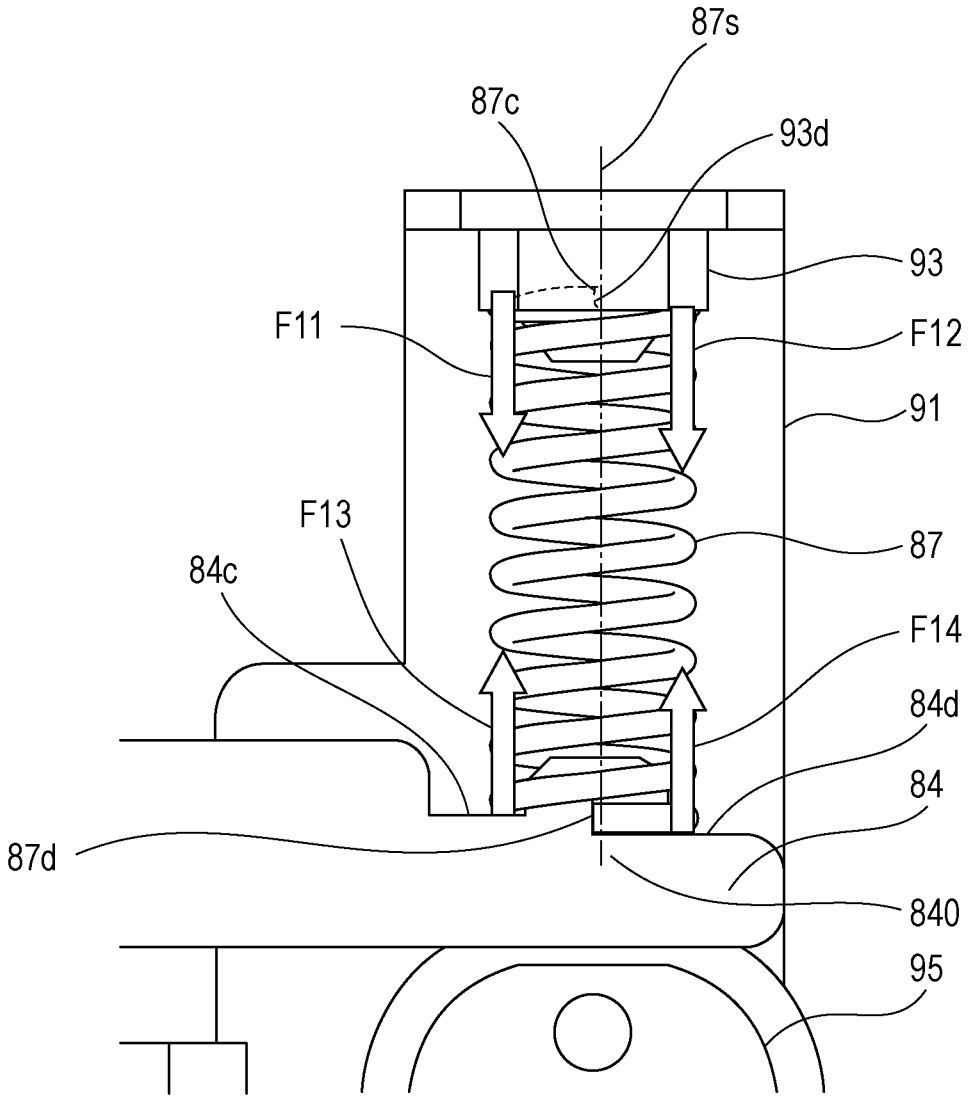
FIG. 8 is a schematic side view of the fixing device according to the first exemplary embodiment.

FIG. 8 is a side view of the fixing device in which the magnitude and direction of the reaction force received by the helical compression spring 87 from the spring support portion 93 and the spring support portion 840 when the helical compression spring 87 is compressed and supported is indicated by an arrow. In FIG. 8, the magnitude is indicated by the length of the arrow, and the direction is indicated by the direction of the arrow. The upper end 87*b* of the helical compression spring 87 substantially uniformly receives the reaction forces F11 and F12 from the groove 93*c* of the spring support portion 93, and the lower end 87*a* substantially uniformly receives the reaction forces F13 and F14 from the spring support area 84*c* and the spring support area 84*d* of the lever 84, respectively. The magnitudes of the reaction forces F11 and F12 at one end of the helical compression spring 87 are substantially the same, and the magnitudes of the reaction forces F13 and F14 at the other end are substantially the same. Accordingly, a rotary force is not exerted on the helical compression spring 87 which is compressed and supported. As a result, the acting force Fs of the spring can efficiently act on the pressure Ft in the nip portion.

While the present exemplary embodiment has been described with reference to the closed-end helical compression spring, the same effect can be provided even when an open-end helical compression spring is employed.

Figure 9A:
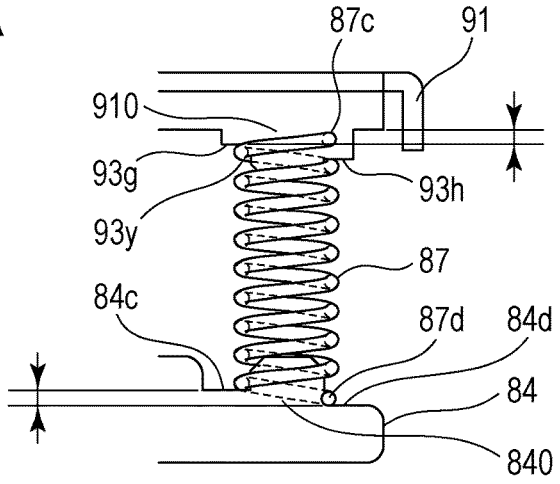
FIGS. 9A to 9C are schematic side views of the fixing device according to an exemplary embodiment using an open-end helical compression spring.
Figure 9B:
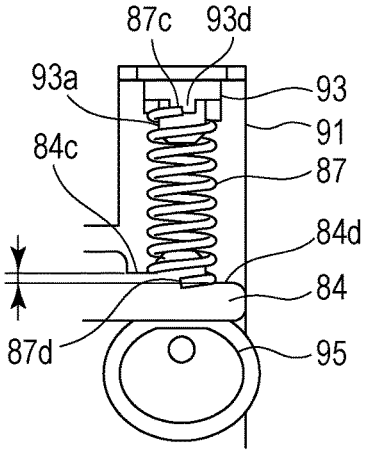

FIGS. 9A and 9B illustrate an exemplary embodiment in which an open-end helical compression spring is supported. FIG. 9A illustrates an exemplary embodiment in which a spring support portion 910 is directly formed in the frame 91. A spring winding end 87*c* of the helical compression spring 87 (one of the winding ends of the helical compression spring 87) is supported by the spring support portion 910, which also serves as a rotation stopper for the helical compression spring 87. The helical compression spring 87 is compressed and supported between the spring support portion 910 and the spring support portion 840 of the lever. The frame 91 has a convex portion 93 formed thereon. The convex portion 93*y* supports the inner diameter of the helical compression spring 87. A spring support area 93*g* and the spring support area 93*h* that support the upper end 87*b* are formed on either side of the convex portion 93*y*. The height level of the spring support area 93*g* that is close to the spring winding end 87*c* in the winding direction of the helical compression spring 87 (a second supporting area is lower than the height level of the spring support area 93*h* (a first supporting area). That is, the spring support area 93*g* is offset from the spring support area 93*h* in the axial direction of the helical compression spring 87 away from the helical compression spring 87. Accordingly, the upper end 87*b* and the lower end 87*a* can be configured so that the spring support areas 93*g* and 93*h* receive the reaction forces having the same magnitude and, in addition, the spring support areas 84*c* and 84*d* receive the reaction forces having the same magnitude. As a result, a rotary force is not exerted on the compressed and supported helical compression spring 87 and, thus, the acting force Fs of the spring can efficiently act on the pressure Ft.

Figure 10A:
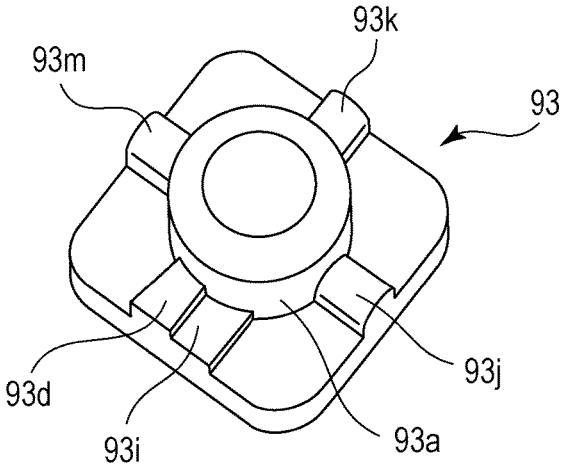
FIGS. 10A and 10B are a perspective view and side views of a spring support member of an exemplary embodiment using an open-end helical compression spring.
Figure 10B:
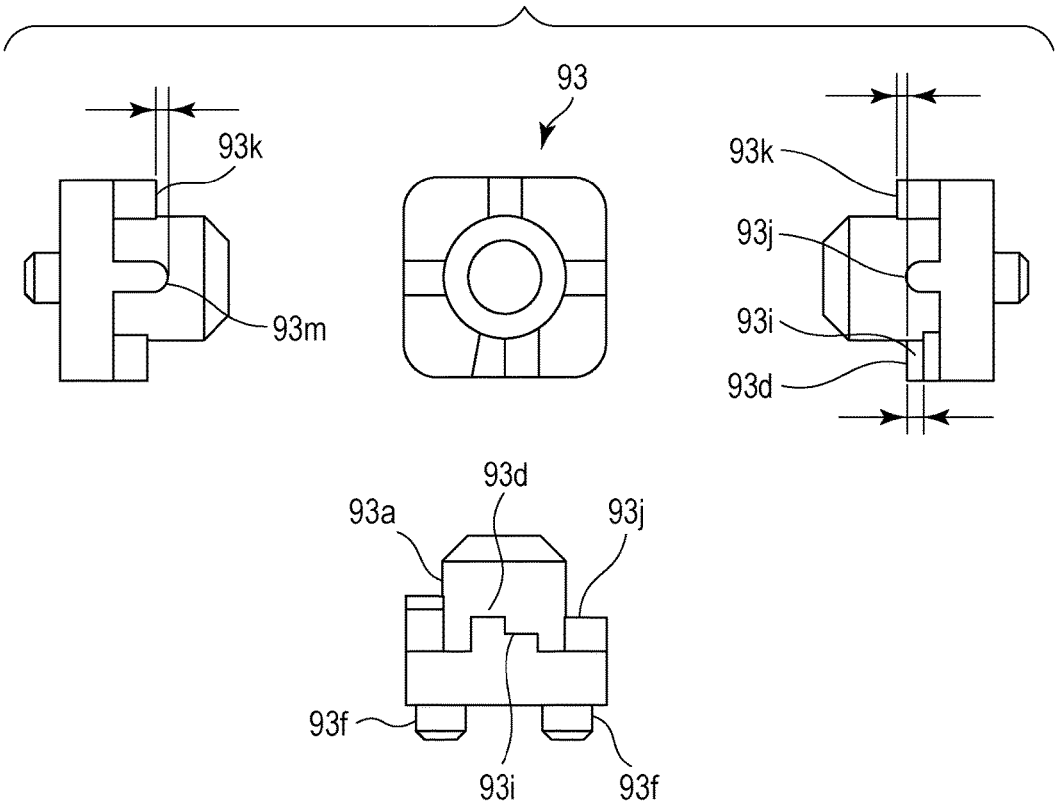
Figure 11:
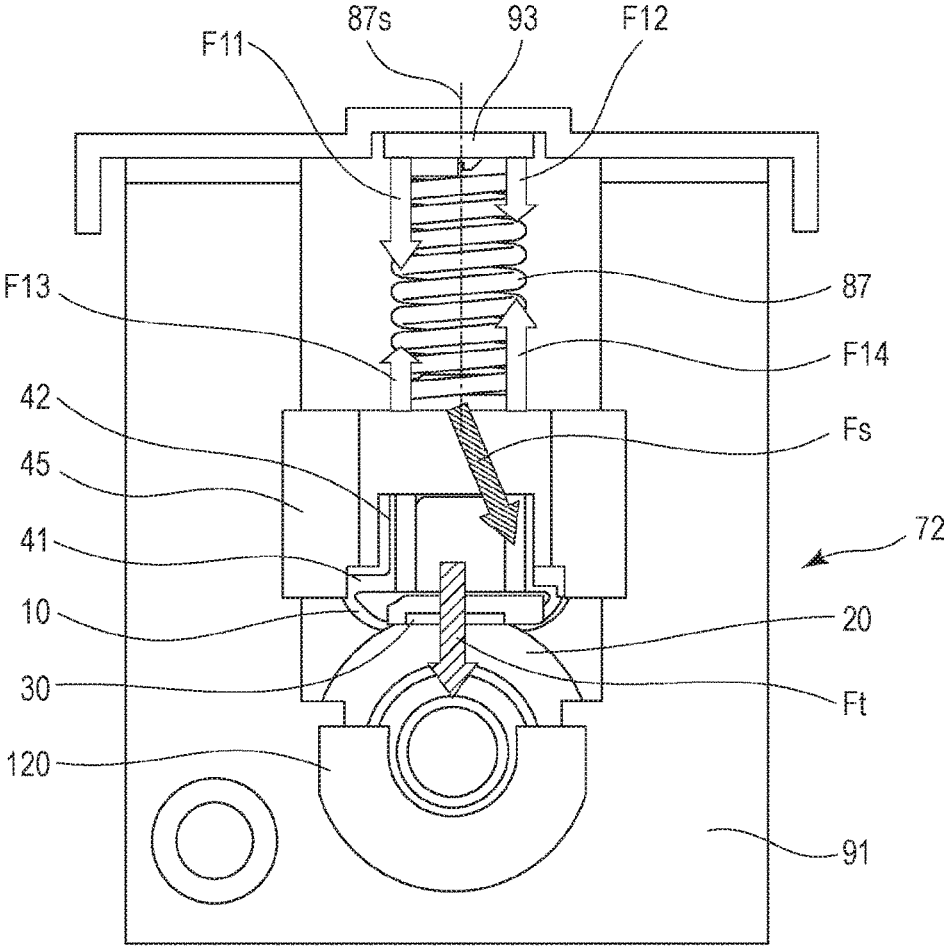
FIG. 11 Prior Art
FIG. 11 is a schematic side view of an existing fixing device.

FIG. 9B illustrates an exemplary embodiment in which the helical compression spring 87 is supported by the spring support portion 93 at four points. FIG. 10A is a perspective view of a spring support portion 93 according to the present exemplary embodiment. FIG. 10B is a top view and side views of a spring support member. A rotation stopper portion 93*d* allows the spring winding end 87*c* to be brought into contact therewith. A spring supporting area 93*i* (a first supporting area) that receives the side surface of the spring is formed next to the flat portion 93*d*. In addition, three supporting areas 93*j*, 93*k*, and 93*m* (second supporting areas) are formed so as to have the rotation center that is the same as the center of a cylindrical portion 93*a* that supports the inner diameter of the spring. The supporting areas 93*j*, 93*k*, and 93*m* are arranged along the winding direction of the helical compression spring 87 that is used so as to have 90-degree phase difference from each other.

As illustrated in FIG. 10B, the four spring support areas are formed so as to be closer to the helical compression spring 87 in the axial direction of the helical compression spring 87 as the helical compression spring 87 extends from the spring supporting area 93*i* to the supporting area 93*m*. As a result, when the helical compression spring 87 is compressed and supported, the helical compression spring 87 received substantially the same reaction force from each of the spring supporting areas 93*i*, 93*j*, 93*k*, and 93*m*. Consequently, no rotary force is applied to the helical compression spring 87 that is compressed and supported between the spring support portion 840 of the lever 84 and the spring support portion 93 and, thus, the acting force Fs can efficiently act on the pressure Ft in the nip portion.

Figure 9C:
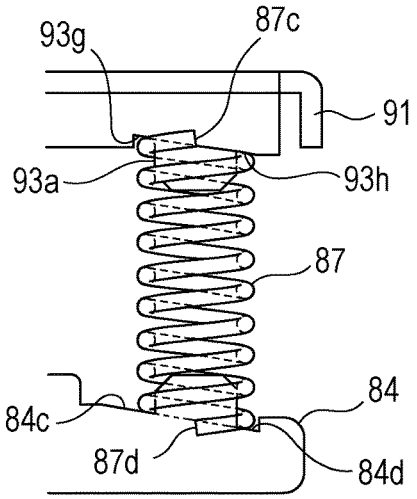

FIG. 9C illustrates an exemplary embodiment in which the surface that is in contact with the helical compression spring 87 is changed to a sloped surface, unlike the configuration illustrated in FIG. 9A. The spring supporting portion is formed so as to be integrated into the frame 91. Each of the spring support area 93*g* and the spring support area 93*h* that support the upper end 87*b* and the spring support area 84*d* and the spring support area 84*c* of the lever 84 is sloped. The spring support areas are closer to the helical compression spring 87 in the axial direction of the helical compression spring 87 as the helical compression spring 87 extends from the spring support area 93*g* that is close to the spring winding end 87*c* to the spring support area 93*h* in the winding direction of the helical compression spring. The spring support areas are closer to the helical compression spring 87 in the axial direction of the helical compression spring 87 as the helical compression spring 87 extends from the spring support area 84*d* that is close to the spring winding end 87*d* to the spring support area 84*c* that is distant from the winding end 87*d* in the winding direction of the helical compression spring. In such a configuration, if the helical compression spring 87 is compressed and supported, one end of the helical compression spring 87 receives the reaction forces that are substantially the same from the spring support areas 93*g* and 93*h* and the other end of the helical compression spring 87 receives the reaction forces that are substantially the same from the spring support areas 84*c* and 84*d*. Accordingly, no rotary force is exerted on the helical compression spring 87 that is compressed and supported and, thus, the acting force Fs can efficiently act on the pressure Ft in the nip portion.

As described above, according to the present invention, the fixing device having a pair of pressure mechanisms using a helical compression spring can reduce the inclination of the helical compression spring and can reduce a decrease in the pressure in the nip portion. While the above-described exemplary embodiment has been described with reference to a right-handed helical compression spring, the same effect can be provided even when a left-handed helical compression spring is employed. That is, it is only required that the spring support areas are formed so as to be closer to the spring in the axial direction of the spring as the spring extends away from the winding end of the spring in the winding direction.

Second Exemplary Embodiment

A fixing device 72 according to the present exemplary embodiment is described below with reference to FIGS. 1A and 1B and FIGS. 12A and 12B. FIGS. 1A and 1B can be applied to the fixing device 72 according to the present exemplary embodiment as in the first exemplary embodiment. Note that in the following description, the term "longitudinal direction" of a member that constitutes the fixing device refers to a direction perpendicular to the recording medium conveyance direction.

Figure 12A:
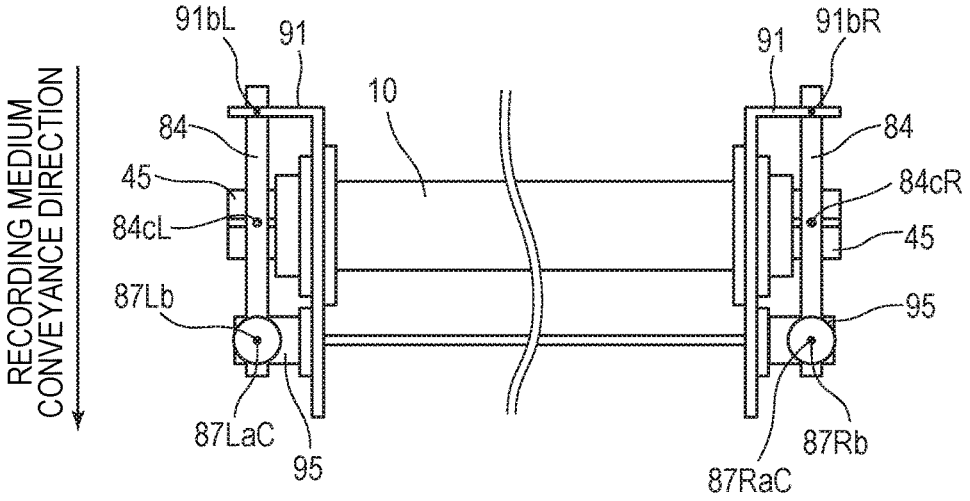
FIGS. 12A and 12B are schematic illustrations of a fixing device according to a second exemplary embodiment.
Figure 12B:
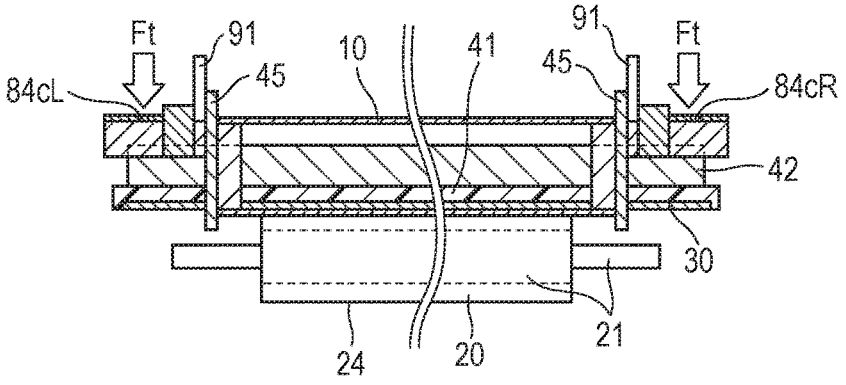

FIG. 1A is a schematic cross-sectional view of the fixing device 72 viewed in the longitudinal direction of the fixing device 72. FIG. 1B is an enlarged view of a nip portion of the fixing device 72. FIG. 12A is a schematic illustration of the fixing device 72 when viewed on a film 10 side of the fixing device. FIG. 12B is a schematic illustration of the fixing device 72 when viewed on the downstream side in a recording medium conveyance direction. For convenience of description, FIGS. 12A and 12B illustrate the configuration including an ideal helical compression spring. That is, the upper and lower spring end surfaces of the helical compression spring 87 are perpendicular to the central axis of the helical compression spring.

According to the present exemplary embodiment, the fixing device 72 includes a cylindrical film 10, a heater 30 in contact with the inner peripheral surface of the film 10, and a pressure roller 20. The heater 30 forms a fixing nip portion N2 together with the pressure roller 20 via the film 10. The fixing device 72 conveys, in the fixing nip portion N2, a recording medium having a toner image formed thereon and, simultaneously, heats the toner image. Thus, the toner image is fixed onto the recording medium. The fixing device 72 further includes a heater holder 41 that supports the heater 30, a pressure stay 42 that increases the bending rigidity, and a fixing flange 45 serving as a regulating member that regulates the movement of the film 10 in the longitudinal direction. The film 10, the heater 30, the heater holder 41, the pressure stay 42, and the fixing flange 45 are integrated into a film unit (a first fixing member). According to the present exemplary embodiment, the fixing device 72 is configured to urge the film unit against the pressure roller 20 (a second fixing member). The film 10 includes a base layer 11 and the release layer 12 provided on the outer surface of the base layer 11. In addition, to increase fixability, an elastic layer 13 formed of, for example, silicone rubber may be disposed between the base layer 11 and the release layer 12. If the elastic layer 13 is provided, an unfixed toner image T borne by a recording medium P can be encompassed and, thus, the heat can be uniformly applied to the toner image. It is desirable that the thickness of the elastic layer 13 be 50 μm and greater and 500 μm or less in order to reduce the warm-up time. The base layer 11 can be generated by forming a thin-wall metal having a high thermal conductivity, such as SUS or Ni, or a heat resistant resin, such as polyimide resin, a polyamide-imide resin, or PEEK, into a thin-wall flexible continuous belt.

To form the release layer 12, a fluorine contained resin, such as PFA, PTFE, FEP, or a mixture thereof, is coated on the outer surface of the base layer 11. Alternatively, the outer surface of the base layer 11 is covered by a tube made of the above-described resin. To increase the durability, it is desirable that the thickness of the release layer 12 be 5 μm and greater. In addition, if the release layer 12 is too thick, the thermal conductivity decreases and, thus, the fixability decreases. Accordingly, it is desirable that the thickness of the release layer 12 be 50 μm and less.

The heater holder 41 is made of liquid crystal polymer, a phenol resin, PPS, or PEEK. The heater holder 41 is formed so as to have a transverse section in the shape of a half-moon gutter. The lower surface of the heater holder 41 (a surface adjacent to the pressure roller 20) has a groove 41*a* having a recess shape formed along the longitudinal direction of the heater holder 41. The heater 30 is supported by the groove 41*a*. The film 10 is loosely fitted onto the outer periphery of the heater holder 41. Both ends of the heater holder 41 (in the longitudinal direction) having the loosely fitting film 10 are supported by both the ends of a frame 91 (not illustrated) via the fixing flange 45.

As illustrated in FIG. 1B, the heater holder 41 includes a protrusion 41*b* provided in the fixing nip portion N2 on the downstream side in the recording medium conveyance direction. The protrusion 41*b* extends along a portion of the heater holder 41 in contact with the inner peripheral surface of the film 10 in the longitudinal direction. The protrusion 41*b* protrudes from a sliding surface of the heater 30 that slides on the film 10 toward the outer surface of the film 10 by a protrusion amount h. The protrusion 41*b* is disposed so as to be located at the same position in the recording medium conveyance direction throughout its length. According to the fixing device of the present exemplary embodiment, the protrusion amount h is set to 0.2 mm. As illustrated in FIG. 1B, a contact portion is divided into two contact portions, that is, a contact portion of the film 10 and the heater 30 and a contact portion of the film 10 and the heater holder 41. As used herein, the term "sliding surface" refers to the contact portion between the film 10 and the heater 30.

As illustrated in FIG. 1A, the pressure roller 20 includes a core shaft portion 21, an elastic layer 22 disposed on the outer surface of the core shaft portion 21, and a release layer 24 disposed on the outer surface of the elastic layer 22. The elastic layer 22 can be formed of, for example, silicone rubber or fluorine-contained rubber.

To form the release layer 24, a fluorine contained resin, such as PFA, PTFE, FEP, or a mixture thereof, is coated. Alternatively, a tube made of the above-described resin is used as the release layer 24.

According to the present exemplary embodiment, the core shaft portion 21 is formed from an iron core shaft having ϕ22, and the elastic layer 22 is formed of the silicone rubber having a thickness of 4 mm. The release layer 24 is formed from a PFA tube having a thickness of 50 μm.

The heater 30 is in contact with the inner peripheral surface of the film 10 and heats the film 10. The heater 30 includes an elongated substrate extending in the longitudinal direction. The substrate can be formed as a ceramic (e.g., alumina or aluminum nitride) substrate or a heat resistant resin (e.g., polyimide, PPS, or liquid crystal polymer) substrate. The substrate has a heating resistor layer on the back surface thereof (a surface remote from the pressure roller 20) along the longitudinal direction of the substrate. The heating resistor layer is applied to the substrate in a band-like shape. The heating resistor layer is formed of, for example, Ag/Pd (silver-palladium), $RuO_2$, or $Ta_2N$. In addition, the substrate has glass coat on the back surface thereof in order to protect the heating resistor layer and ensure electrical insulation. Furthermore, the substrate has a sliding layer on a surface thereof that is in contact with the inner peripheral surface of the film 10 in order to increase the slidability. The sliding layer is formed of, for example, a heat resistant resin (e.g., a polyimide or polyamide-imide resin) or glass coat. According to the present exemplary embodiment, the size of the substrate of the heater 30 is 350 mm in the longitudinal direction, 10 mm in the short direction, and 0.6 mm in the thickness direction.

The pressure stay 42 is formed into a U shape using a material having rigidity (e.g., a metal). The pressure stay 42 is disposed on the upper surface of the heater holder 41 (a surface remote from the pressure roller 20) inside the film 10. The pressure stay 42 urges both ends of the pressure stay 42 in the longitudinal direction toward the axial line of the pressure roller 20 via the fixing flange 45 supported by the frame 91. Thus, the heater 30 is urged against the surface of the pressure roller 20 via the film 10, and an inner nip N3 having a predetermined width is formed between the heater 30 and the film 10. In addition, a fixing nip N2 having a predetermined width is formed between the film 10 and the pressure roller 20. Heat necessary for the heat fixing of the unfixed toner image T is transferred from the heater 30 to the film 10 in the inner nip N3, and the heat is transferred from the film 10 to the recording medium P in the fixing nip N2. At that time, the recording medium is conveyed.

Upon receiving a print instruction, a control unit 44 drives a motor serving as a driving source to rotate a drive gear disposed at an end of the core shaft portion 21 of the pressure roller 20 in the longitudinal direction. Thus, the pressure roller 20 rotates at a predetermined circumferential velocity in a direction of an arrow. At that time, a rotary force that attempts to rotate the film 10 in a direction opposite to the rotational direction of the pressure roller 20 is exerted on the film 10 due to a frictional force generated between the surface of the pressure roller 20 and the surface of the film 10 in the fixing nip N2. In this manner, the film 10 is driven to rotate in the direction of the arrow at a circumferential velocity that is substantially the same as that of the pressure roller 20 outside the heater holder 41 with the inner peripheral surface of the film 10 in contact with the sliding layer of the heater 30.

A thermistor 35 serving as a temperature detecting unit detects the temperature of the film 10 and outputs a temperature detection signal to the control unit 44. The thermistor 35 is disposed so as to be capable of detecting the temperature of an area through which the recording medium P having any of all the sizes allowable for the fixing device 72 passes. The control unit 44 receives the temperature detection signal from the thermistor 35 and controls the power supplied to the heating resistor layer on the basis of the temperature detection signal so that the film 10 has a predetermined target temperature.

In this manner, the recording medium P having the unfixed toner image T thereon is led to the fixing nip N2 along an entry guide 28 with the temperature of the film 10 maintained at the predetermined target temperature. Thereafter, the recording medium P is pinched by the film 10 and the pressure roller 20 and is conveyed. In the conveyance stage, the heat of the film 10 heated by the heater 30 and the pressure from the fixing nip N2 are applied to the recording medium P. Due to the heat and pressure, the unfixed toner image T is fixed onto the surface of the recording medium P. After passing through the fixing nip N2, the recording medium P is separated from the film 10 by self stripping and is ejected by the conveyance roller 26.

Figure 13:
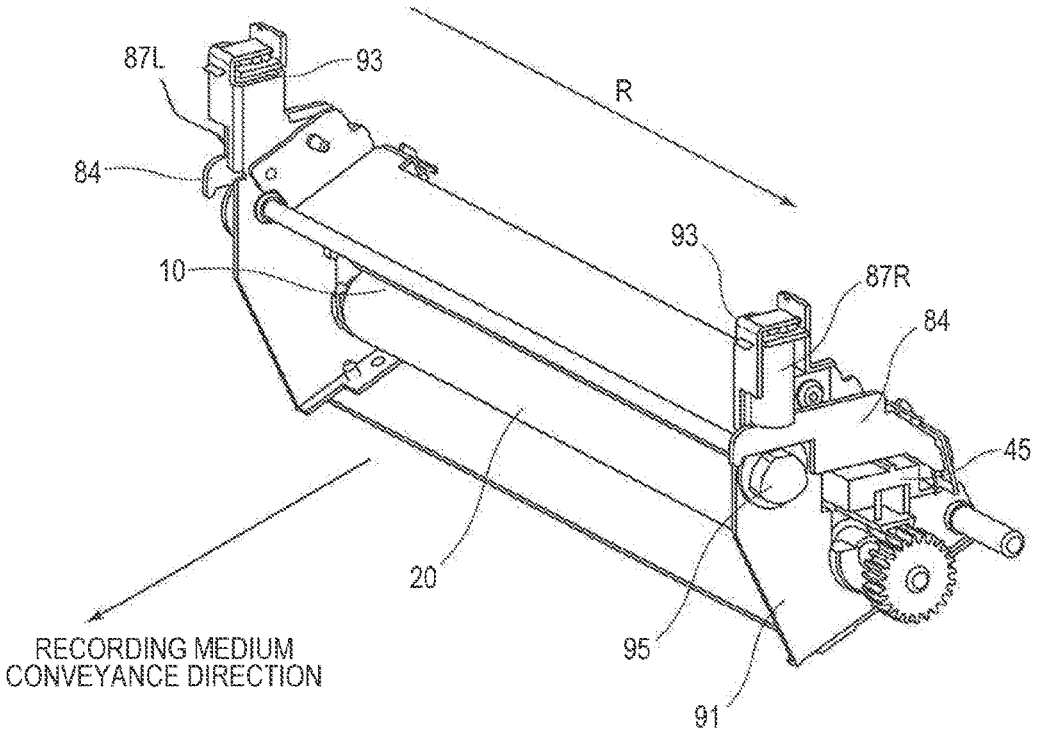
FIG. 13 is a perspective view of the fixing device according to the second exemplary embodiment.
Figure 14A:
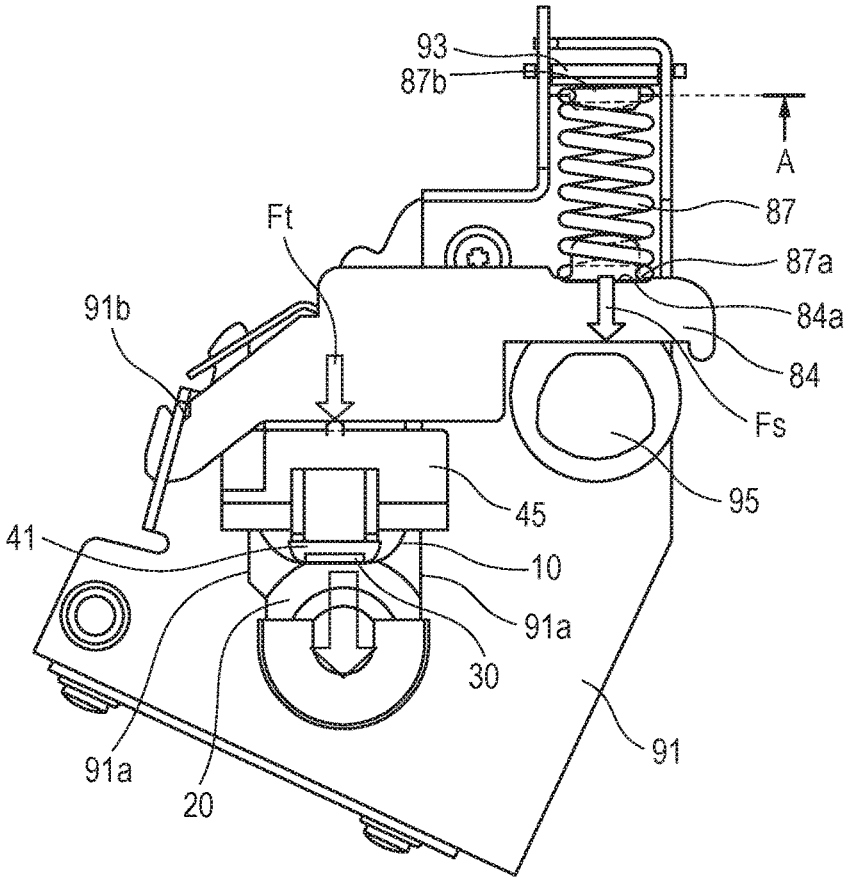
FIGS. 14A and 14B are side views of the fixing device according to the second exemplary embodiment.

The pressure mechanism according to the present exemplary embodiment is described below with reference to FIGS. 13 and 14A. FIG. 13 is a perspective view of the fixing device 72. FIG. 14A is a side view of the fixing device 72 viewed in a direction of an arrow R in FIG. 13. The pressure roller 20 is rotatably supported by a frame 91 disposed at both ends of the pressure roller 20 in the longitudinal direction via a bearing (not illustrated). A guide portion 91*a* that regulates the direction in which the film unit is pressed is disposed on the frame 91.

Each of a pair of the pressure mechanisms includes a lever 84, a turning center 91*b* and a spring support portion 93 provided in the frame 91, and a helical compression spring 87. The pressure mechanisms are provided at either end of the film 10 in the longitudinal direction.

The lever 84 is a member having one end supported by the turning center 91*b* in the frame 91 in a rotatable manner in a direction in which the film 10 is pressed. The helical compression spring 87 is disposed and compressed between the other end of the lever 84 and a spring support portion 93 of the frame 91. The other end of the lever 84 supports a lower end 87*a* of the helical compression spring 87. In contrast, the spring support portion 93 is formed in the frame 91 and supports the upper end 87*b* of the helical compression spring 87. The spring support portion 93 has a function of regulating the height of the helical compression spring 87 so that the pressure of the helical compression spring 87 is maintained at a predetermined pressure (a specified load). According to the present exemplary embodiment, the helical compression spring 87 has a free height of 35 mm and a specified height of 27 mm upon pressurization. The lever 84 can rotate about the turning center 91*b* due to the elastic force of the helical compression spring 87 and exerts a pressure Ft on the fixing flange 45 via the lever 84. Thus, the lever 84 can urge the film unit against the pressure roller 20. Note that by moving the lever 84 in a direction in which the helical compression spring 87 is compressed using a cam member 95, the pressure applied in the fixing nip N2 can be released.

In the following description of the helical compression spring, the direction of an arrow R illustrated in FIG. 13 is the right direction, and the direction opposite to the direction of the arrow R is the left direction. The helical compression spring 87 located on the right side of the fixing device in the longitudinal direction is referred to as "helical compression spring 87R", and the helical compression spring 87 located on the left side of the fixing device in the longitudinal direction is referred to as "helical compression spring 87L".

Figure 14B:
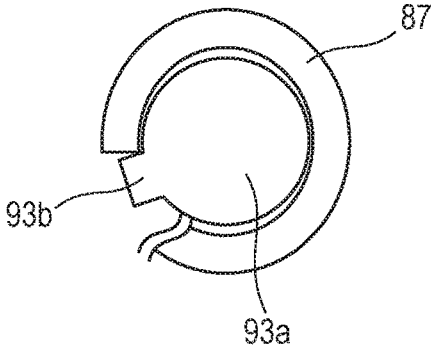

The pressure mechanism according to the present exemplary embodiment is characterized in that the winding direction of the helical compression spring 87R is opposite to the winding direction of the helical compression spring 87L. In the present exemplary embodiment illustrated in FIGS. 14A and 14B, the helical compression spring 87R is a right-handed helical compression spring, and the helical compression spring 87L is a left-handed helical compression spring. In addition, the pressure mechanism according to the present exemplary embodiment is characterized in that the position of the winding end of the helical compression spring 87R is substantially symmetrical to the position of the winding end of the helical compression spring 87L with respect to the transverse plane in the middle of the film 10 in the longitudinal direction. A technique to determine the phase of the winding ends of the helical compression spring 87 is described below with reference to FIG. 14B. FIG. 14B illustrates a spring terminal of the helical compression spring 87 and the spring support portion 93 viewed in a direction of an arrow A of FIG. 14A. The spring support portion 93 includes a cylindrical portion 93*a* having a diameter close to the inner diameter of the helical compression spring 87 and a convex portion 93*b* that determines the phase of the winding ends of the helical compression spring 87. In the pressure mechanisms at either end of the film 10, the convex portions 93*b* of the pressure mechanisms are disposed at positions so as to be substantially symmetrical with respect to the transverse plane in the middle of the film 10 in the longitudinal direction. The pressure mechanism according to the present exemplary embodiment has a configuration so that the phase of the winding end is determined by lightly press-fitting the upper end 87*b* of the helical compression spring 87 to the cylindrical portion 93*a* with a phase of the winding end of the upper end 87*b* being in contact with the convex portion 93*b*.

Figure 15A:
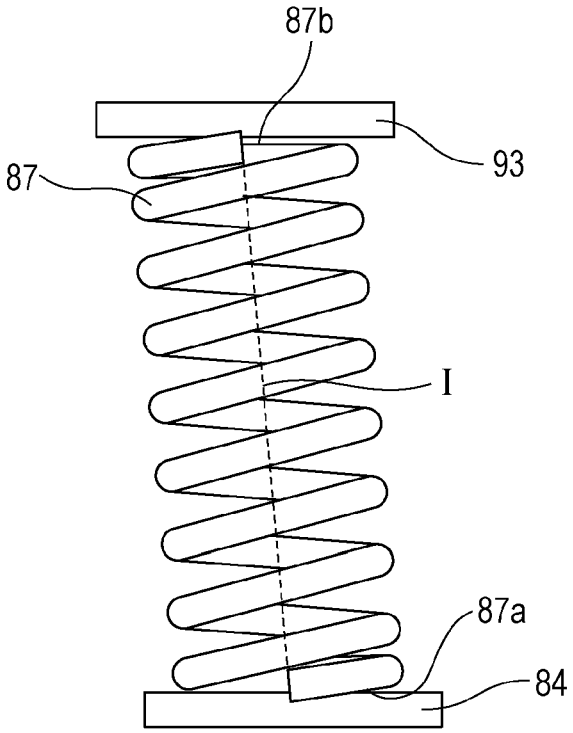
FIGS. 15A and 15B are side views of a helical compression spring according to the second exemplary embodiment.
Figure 15B:
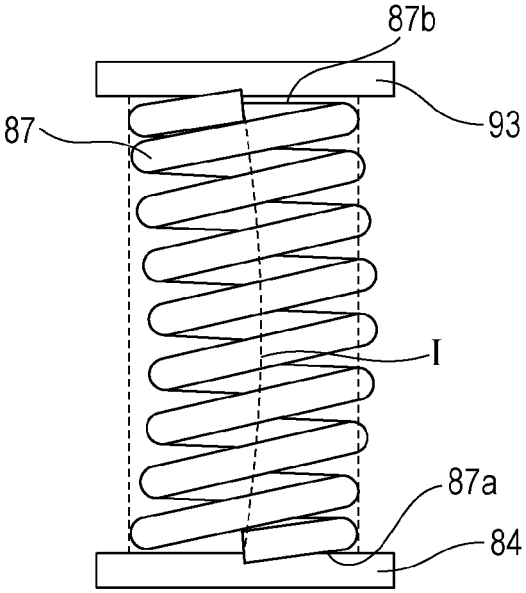
Figure 16A:
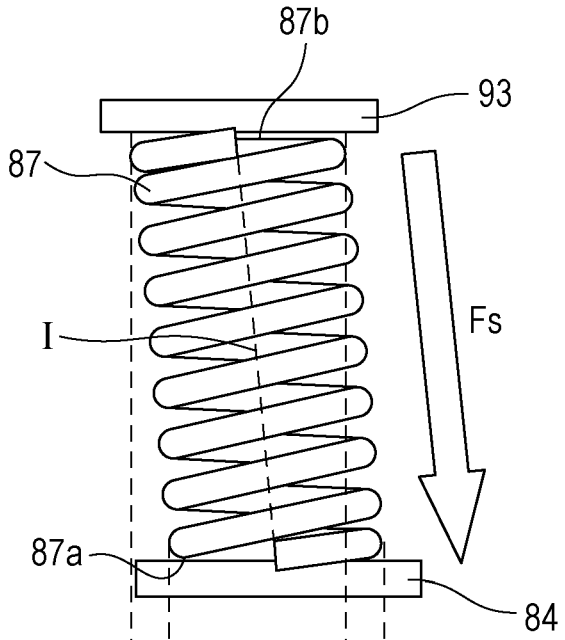
FIGS. 16A and 16B are schematic illustrations of the helical compression spring according to the second exemplary embodiment.
Figure 16B:
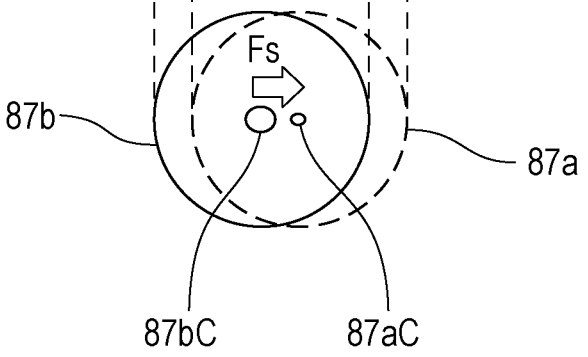

The behavior of the helical compression spring 87 when the helical compression spring 87 is compressed and the effect in the above-described configuration are described below. FIG. 15A is a transverse sectional view of the helical compression spring 87 placed on the lever 84 without being compressed. FIG. 15B is a side view of the helical compression spring 87 compressed so that the positions of the lower end 87*a* and the upper end 87*b* are aligned using the spring support portion 93 and the lever 84. The coil central axis of the helical compression spring 87 is not perpendicular to the receiving surface of the spring end due to the step formed between the spring winding portion and the spring winding end at the spring terminal. That is, the coil central axis is inclined from the perpendicular line of the receiving surface. The direction in which the central axis is inclined is related to the phase of the spring winding ends. When the helical compression spring 87 is compressed so that the position of the lower end 87*a* of the helical compression spring 87 is aligned with the position of the upper end 87*b*, the helical compression spring 87 bends, as illustrated in FIG. 15B. A play is provided between the lever 84 having a receiving surface 84*a* that receives the lower end 87*a* at one end and the turning center 91*b* in the frame 91. Accordingly, the lever 84 moves such that the bend of the helical compression spring is reduced. FIG. 16A is a side view of the helical compression spring 87 after the lever 84 has moved such that the bend of the helical compression spring is reduced. As illustrated in FIG. 16A, the center 87*b*C of the upper end 87*b* is deviated from the center 87*a*C of the lower end 87*a*. The direction of the deviation of the center 87*b*C of the upper end 87*b* from the center 87*a*C of the lower end 87*a* is determined by the phase of the spring winding ends. FIG. 16B illustrates the positional relationship between the center 87*b*C of the upper end 87*b* and the center 87*a*C of the lower end 87*a* of the helical compression spring 87.

Figure 17A:
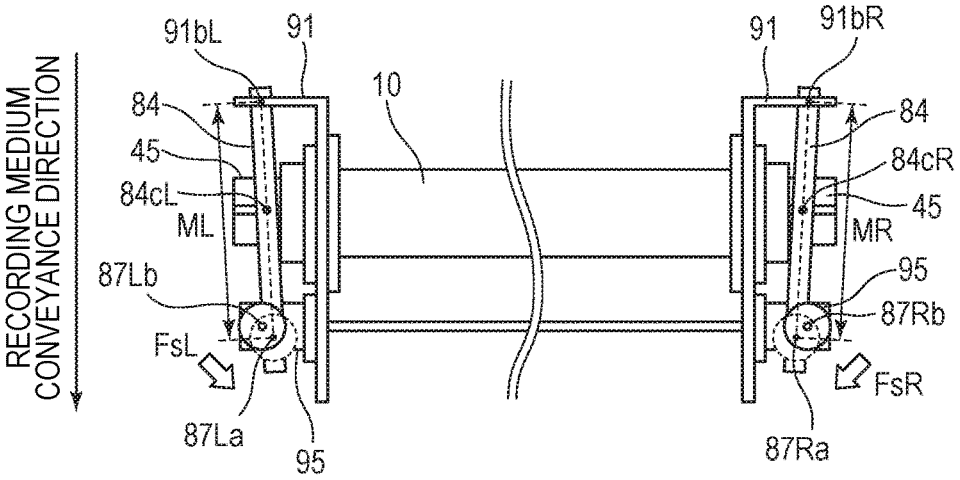
FIGS. 17A and 17B are schematic illustrations of the fixing device according to the second exemplary embodiment.
Figure 17B:
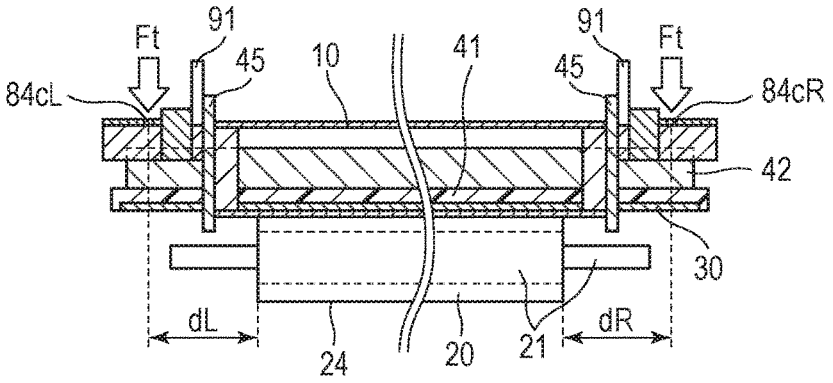

FIG. 17A is a schematic illustration of the fixing device 72 as viewed from above in a direction perpendicular to a nip surface according to the present exemplary embodiment. FIG. 17B is a schematic illustration of the fixing device 72 as viewed in the downstream side in the recording medium conveyance direction. Let 87Rb denote the upper end of the helical compression spring 87R, and let 87Ra denote the lower end of the helical compression spring 87R. Let 87Lb denote the upper end of the helical compression spring 87L and let 87La denote the lower end of the helical compression spring 87L. According to the present exemplary embodiment, when the helical compression spring 87 is compressed and, thus, the pressure is generated, the lever 84 moves in a direction such that the bend of the helical compression spring 87 is released. Since the winding directions of the helical compression spring 87R and the helical compression spring 87L are opposite to each other and, in addition, the positions of the winding ends are located so as to be substantially symmetrical, the directions in which the levers 84 move to reduce the bends are symmetrical with respect to the transverse plane in the middle of the film 10 in the longitudinal direction. Accordingly, the levers 84 are positioned as indicated in FIG. 17A. The point 84*c* of application of the pressure Ft is shifted in the longitudinal direction of the film 10, from the position in the configuration in which an ideal helical compression spring that generates no bend is employed illustrated in FIGS. 12A and 12B.

In addition, the slope of the central axis of the helical compression spring 87R is symmetrical to the slope of the central axis of the helical compression spring 87L with respect to the transverse plane in the middle of the film 10 in the longitudinal direction. Similarly, a pressure vector FsR of the helical compression spring 87R is symmetrical to a pressure vector FsL of the helical compression spring 87L with respect to the transverse plane in the middle of the film 10 in the longitudinal direction.

According to the present exemplary embodiment, the point 84*c* of application of the pressure Ft is shifted toward the middle of the film in the longitudinal direction. However, a distance dL between a point 84*c*L of application of the pressure Ft applied to a left film guide 45 and a left nip end is the same as a distance dR between a point 84*c*R of application of the pressure Ft applied to a right film guide 45 and a right nip end. In addition, in the configuration according to the present exemplary embodiment, the center 87*a*C of the lower end, which is the point of effort of the pressure Fs, is shifted in the recording medium conveyance direction. However, a distance ML between the center 87LaC of the lower end, which is the point of effort of the left pressure Fs, and a turning center 91*b*L is the same as a distance MR between the center 87RaC of the lower end, which is the point of effort of the left pressure Fs, and a turning center 91*b*R. Accordingly, the pressures Fs applied to the turning center 91*b* on the right and left sides are the same. As a result, a difference in surface pressure applied to the turning center 91*b* between right and left is less likely to occur and, thus, the difference in fixability level between right and left portions of the image can be reduced.

For ease of understanding of the effect of the present exemplary embodiment, the pressure configuration of a comparative example is described below. In the Comparative example, the helical compression spring 87R and the helical compression spring 87L are of the same type. Accordingly, the winding directions of the helical compression spring 87R and the helical compression spring 87L are the same. In addition, the helical compression spring 87R and the helical compression spring 87L are disposed so that the position of the winding end of the helical compression spring 87R has the same phase as the winding end of the helical compression spring 87L, or the position of the winding end of the helical compression spring 87R has the same phase as the winding end of the helical compression spring 87L if the helical compression spring 87L is rotated about the axis by 180°. In Comparative example 1 described below, the helical compression spring 87R and the helical compression spring 87L are disposed so that the position of the winding end of the helical compression spring 87R has the same phase as the position of the winding end of the helical compression spring 87L. In contrast, in Comparative example 2 described below, the helical compression spring 87R and the helical compression spring 87L are disposed so that the position of the winding end of the helical compression spring 87R has the same phase as the winding end of the helical compression spring 87L if the helical compression spring 87L is rotated about the axis by 180°.

Figure 18A:
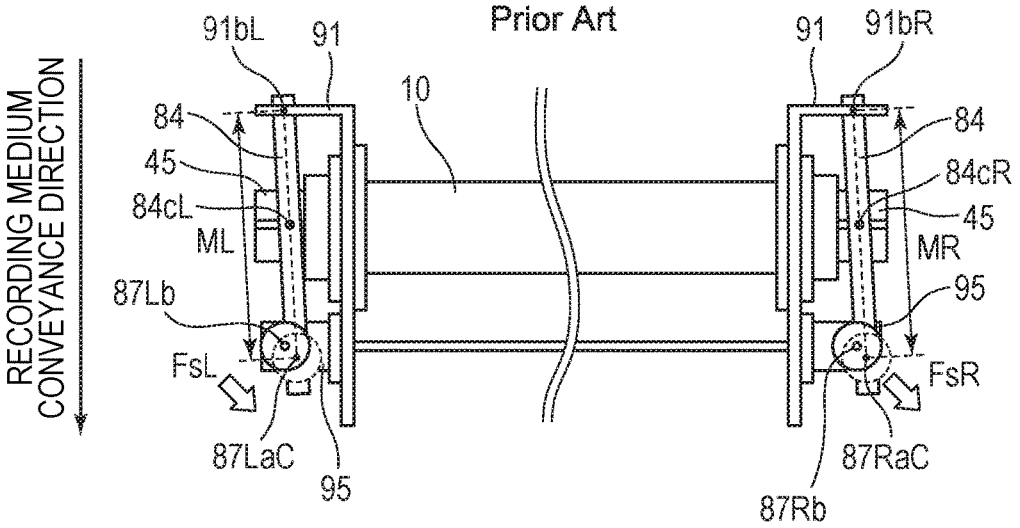
FIG. 18A Prior Art
FIGS. 18A and 18B are schematic illustrations of a fixing device according to Comparative Example 1.
Figure 18B:
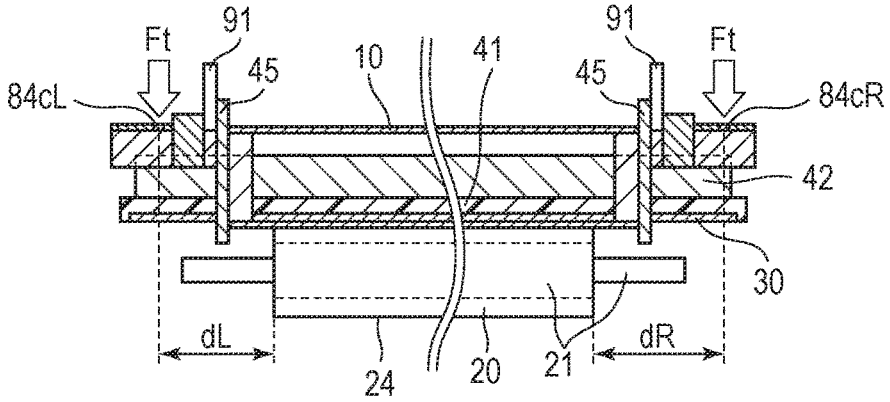
FIG. 18B Prior Art

FIG. 18A is a schematic illustration of the fixing device 72 as viewed from above in a direction perpendicular to a nip surface according to Comparative example 1. FIG. 18B is a schematic illustration of the fixing device 72 as viewed from the downstream side in the recording medium conveyance direction. When the helical compression spring 87 is compressed and, thus, a pressure is generated, the lever 84 moves from the position thereof in the configuration in which an ideal helical compression spring is employed illustrated in FIGS. 12A and 12B in order to reduce the bend of the helical compression spring 87. Since the winding directions of the helical compression spring 87R and the helical compression spring 87L are the same and, in addition, the helical compression spring 87R and the helical compression spring 87L are disposed so that the positions of the winding ends have the same phase, the directions of the bends of the helical compression spring 87R and the helical compression spring 87L are the same. Accordingly, the directions in which the levers 84 move in order to reduce the bends are the same. Consequently, as illustrated in FIG. 18A, the point 84*c* of application of the pressure Ft is shifted in the longitudinal direction of the film 10. At that time, the distance dL between the point 84*c*L of application of the pressure Ft applied to the left film guide 45 and the left nip end is shorter than the distance dR between the point 84*c*R of application of the pressure Ft applied to the right film guide 45 and the right nip end. According to the principle of leverage, as the point 84*c* of application of the pressure moves toward the nip end, the surface pressure applied to the nip end increases. Thus, the surface pressure on the left side of the nip is low, and the surface pressure on the right side of the nip is high. That is, the surface pressures on the right side and the left side in the nip differ from each other. Accordingly, the fixability on the left side in the longitudinal direction tends to be worse than the fixability on the right side in the longitudinal direction.

Figure 19A:
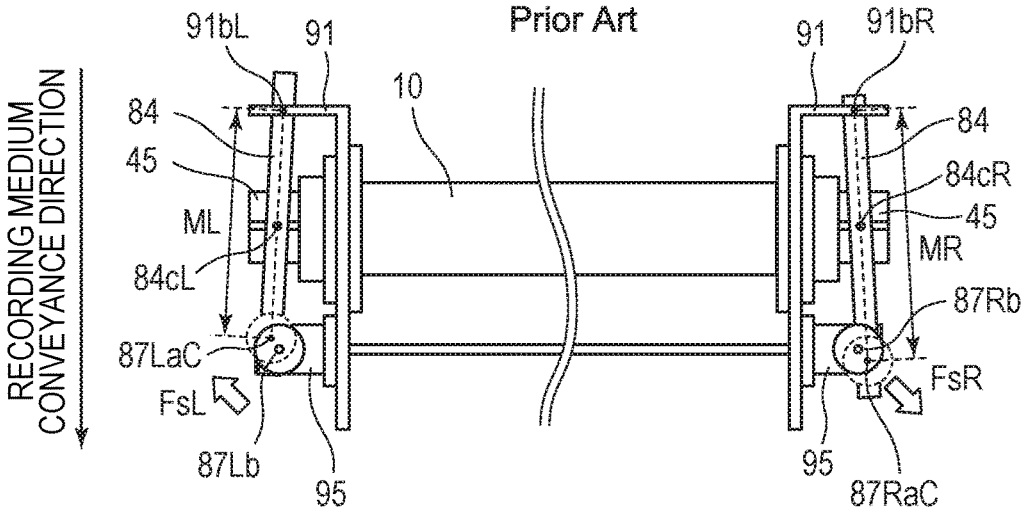
FIG. 19A Prior Art
FIGS. 19A and 19B are schematic illustrations of a fixing device according to Comparative Example 2.
Figure 19B:
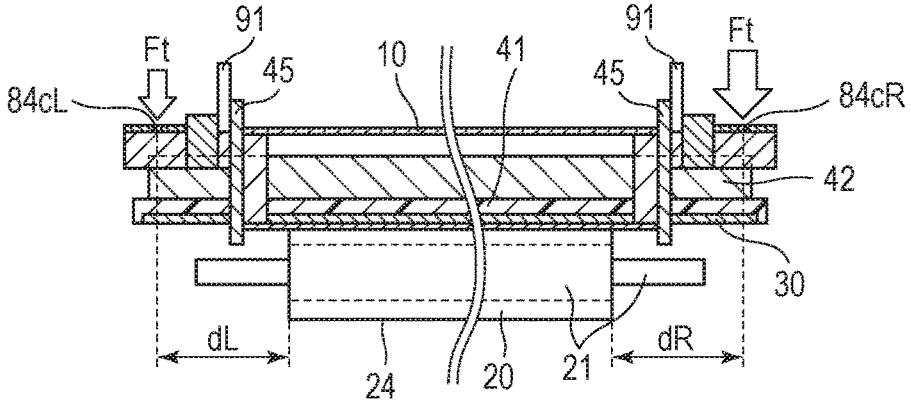
FIG. 19B Prior Art

FIG. 19A is a schematic illustration of the fixing device 72 as viewed from above in a direction perpendicular to the nip surface according to Comparative example 2. FIG. 19B is a schematic illustration of the fixing device 72 as viewed from the downstream side in the recording medium conveyance direction.

When the helical compression spring 87 is compressed and, thus, a pressure is generated, the lever 84 moves from the position thereof in the configuration in which an ideal helical compression spring is employed illustrated in FIGS. 12A and 12B in order to reduce the bend of the helical compression spring 87. Since the winding directions of the helical compression spring 87R and the helical compression spring 87L are the same and, in addition, the helical compression spring 87R and the helical compression spring 87L are disposed so that the position of the winding end of the helical compression spring 87R has the same phase as the winding end of the helical compression spring 87L if the helical compression spring 87L is rotated about the axis by 180°, the directions of the bends of the helical compression spring 87R and the helical compression spring 87L are opposed 180° from each other. Accordingly, the directions in which the levers 84 move in order to reduce the bends are also opposed 180° from each other. Consequently, as illustrated in FIG. 19A, the center 87*a*C of the lower end, which is the point of application of the pressure Fs, is shifted from the point indicated in FIGS. 12A and 12B. If the center 87*a*C of the lower end, which is the point of application of the pressure Fs, is located at the point indicated in FIGS. 19A and 19B, the distance ML between the center 87LaC of the lower end, which is the point of effort of a left pressure FsL, and the turning center 91*b*L is shorter than that indicated by FIGS. 12A and 12B. In contrast, the distance MR between the center 87RaC of the lower end, which is the point of effort of a right pressure FsR, and the turning center 91*b*R is longer than that indicated by FIGS. 12A and 12B. Accordingly, the moment arm of the pressure Fs with respect to the turning center 91*b* on the right side is longer than on the left side. Thus, the pressure Ft on the right side is greater than on the left side. Consequently, the surface pressure on the left side in the nip is low, and the surface pressure on the right side in the nip is high. Accordingly, the fixability on the left side tends to be worse than the fixability on the right side.

The result of comparison of Comparative example 1, Comparative example 2, and the present exemplary embodiment in terms of the difference in fixability in the longitudinal direction of an image is illustrated in Table 1. In addition, the result of comparison of Comparative example 1, Comparative example 2, and the present exemplary embodiment in terms of gloss level in the longitudinal direction is illustrated in Table 2.

TABLE 1

| Fixability Evaluation | Position 30 mm from Left Edge of Recording Medium | Middle of Recording Medium | Position 30 mm from Right Edge of Recording Medium | Difference in Fixability between Right and Left |
|---|---|---|---|---|
| Comparative example 1 | Excellent | Excellent | poor | YES |
| Comparative example 2 | Excellent | Excellent | poor | YES |
| Present Embodiment | Excellent | Excellent | Excellent | NO |

TABLE 2

| Gloss Evaluation | Position 30 mm from Left Edge of Recording Medium | Middle of Recording Medium | Position 30 mm from Right Edge of Recording Medium | Difference in Fixability between Right and Left |
|---|---|---|---|---|
| Comparative example 1 | Excellent | Excellent | Fair | YES |
| Comparative example 2 | Excellent | Excellent | Poor | YES |
| Present Embodiment | Excellent | Excellent | Excellent | NO |

In the evaluation, Xerox Business 4200 (75 g/m2) letter paper sheets were used as the recording media P. In addition, a uniform image that covered the entire page of the recording medium was printed as the toner image T, which was heat fixed to the recording media P using the fixing devices having the above-described configurations.

To evaluate the fixability performance, an adhesive cellophane tape was put on the toner image fixed onto the recording medium P by a surface pressure of 0.49 N/cm$^2$ (50 gf/cm$^2$) for one minute and, thereafter, the cellophane tape was removed. Then, evaluation was made on the basis of the level of the image failure of the toner image (caused by the removal of the cellophane tape). If the image failure exceeds 5% of the toner image, the fixability performance is evaluated as "poor". In contrast, if the image failure is less than or equal to 5% of the toner image, the fixability performance is evaluated as "excellent".

The gloss evaluation was made using a gloss meter available from Nippon Denshoku Industries Co., LTD. If the measured value is less than or equal to 10%, the gloss is evaluated as "poor". If the measured value is between 10% and 13%, the gloss is evaluated as "fair". If the measured value is greater than or equal to 13%, the gloss is evaluated as "excellent". The fixability performance and the gloss were evaluated in the following manner. That is, three points were selected in the recording medium so as to be arranged in a direction perpendicular to the recording medium conveyance direction (hereinafter referred to as "three points in the longitudinal direction of the film 10"). The mean value of the measured values at each of the three points in the recording medium conveyance direction was calculated. The three mean values were used for evaluation in the longitudinal direction of the film. The three points in the recording medium conveyance direction are points 39.4 mm, 139.4 mm, and 239.4 mm from the leading edge of the recording medium in the recording medium conveyance direction. The three points in the longitudinal direction of the film 10 are two points 30 mm from the right edge and the left edge in a direction perpendicular to the recording medium conveyance direction and a point 107.95 mm from each of the edges (in the middle of the recording medium in the direction perpendicular to the recording medium conveyance direction).

As can be seen from the results indicated by Tables 1 and 2, according to the present exemplary embodiment, the difference in the fixability performance and the difference in the gross between right and left can be reduced more than in each of the Comparative examples 1 and 2.

The following configuration is discussed below. That is, as illustrated in FIG. 1B, the protrusion 41*b* is provided downstream of the heater holder 41 in the recording medium conveyance direction so as to extend along the longitudinal direction of a portion of the heater holder 41 in contact with the inner peripheral surface of the film 10. The protrusion 41*b* crushes toner particles on the recording medium that are melted in the inner nip N3 so as to improve the fixability and the gloss. However, the function of the protrusion 41*b* to improve the fixability and the gloss is easily influenced by the surface pressure in the nip. For example, if there is a portion having a low surface pressure in the nip, the portion is more easily recognized as a gloss difference in the configuration having the protrusion 41*b* than in the configuration having no protrusion 41*b*. In particular, when, as in the Comparative examples, the difference in pressure between right and left occurs, the difference in gloss and the difference in fixability easily occur. According to the configuration of the present exemplary embodiment, the difference in the surface pressure in the nip between right and left is reduced and, thus, the difference in gloss and the difference in fixability between right and left can be reduced.

In addition, as described above, for the configuration that rotates the lever 84 using the cam member 95 and pushes up the helical compression spring 87 to compress the helical compression spring 87 to release the pressure, the effect of improvement using the present exemplary embodiment is great. Since the helical compression spring 87 is more compressed when the pressure is released than under the pressurization condition, the helical compression spring 87 bends more than under the pressurization condition. Thus, the force to straighten out the bend increases. Consequently, the force to move the lever 84 increases, and the moving distance increases. Accordingly, the difference in the surface pressure in the nip between right and left caused by the movement of the lever in the Comparative examples 1 and 2 is increased. However, according to the configuration of the present exemplary embodiment, even when the moving distance is large, the right and left levers 84 move in the opposite directions. Accordingly, the difference in the surface pressure in the nip between right and left is less likely to occur.

As described above, according to the present exemplary embodiment, the difference in fixability and gloss (uneven fixability and uneven gloss) in an image can be reduced. In addition, since the difference in the surface pressure in the nip between right and left can be reduced, the difference in the conveyance force between both the ends of a recording medium is less likely to occur and, thus, the occurrence of wrinkling on a recording medium can be prevented.

In Comparative example 1 and Comparative example 2, wear of the rotary member is accelerated at a point at which the surface pressure in the nip is high. Thus, the lifetime of the fixing device is reduced. According to the configuration of the present exemplary embodiment, the difference in the surface pressure in the nip can be reduced. Thus, the lifetime of the fixing device can be increased from that of each of Comparative example 1 and Comparative example 2.

Note that the effect to increase the recording medium conveyance performance in the fixing nip N2 of the pressure mechanism of the fixing device according to the present exemplary embodiment can be applied to recording medium conveyance devices that convey a recording medium using a nip portion formed by two rotary members (first and second rotary members) in tight contact with each other, in addition to fixing devices.

Third Exemplary Embodiment

A fixing device according to the third exemplary embodiment is described below with reference to FIGS. 20 to 24. Note that in the present exemplary embodiment, description of constituent elements that are similar to those of the second exemplary embodiment is not repeated. Only a pressure mechanism that applies the pressure Ft and the location of the helical compression spring 87 differ from those of the second exemplary embodiment.

Figure 20:
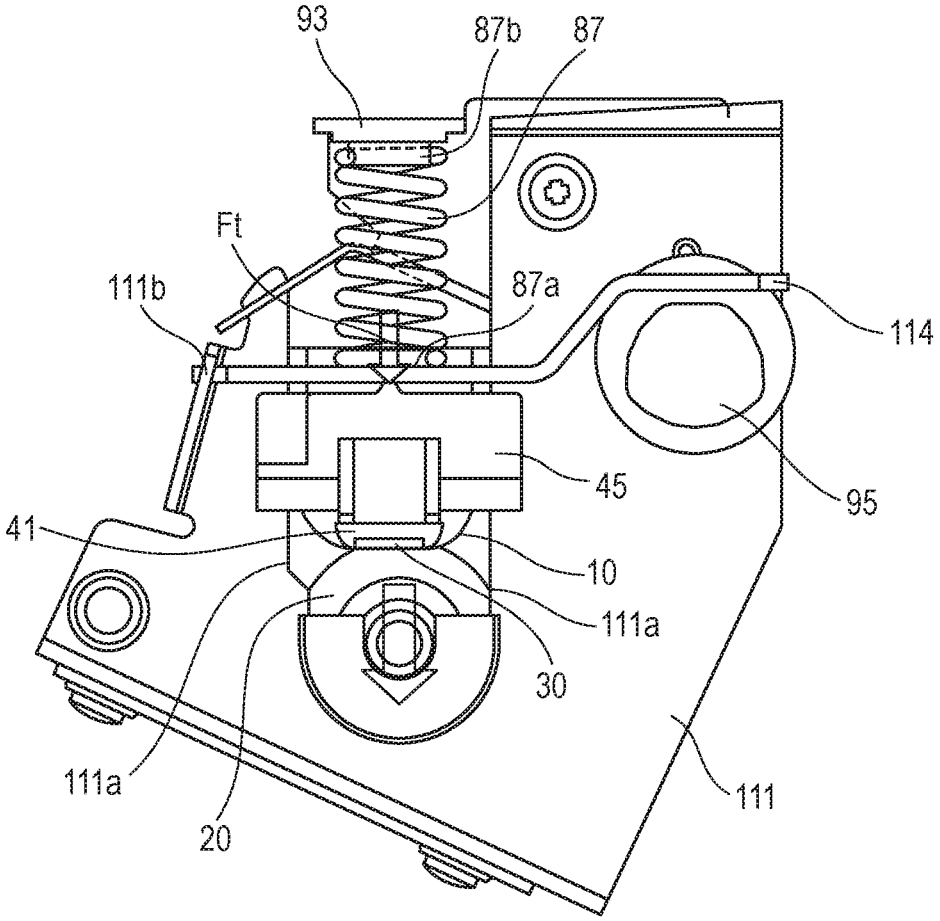
FIG. 20 is a side view of a fixing device according to a third exemplary embodiment.

FIG. 20 is a side view of the fixing device according to the present exemplary embodiment. The fixing device according to the present exemplary embodiment is described next with reference to FIG. 20. A fixing flange 45 and a pressure roller 20 are supported by a frame 111 disposed on either end of the pressure mechanism in the longitudinal direction. A guide portion 111*a* that regulates the direction in which a film unit is urged against the pressure roller 20 is disposed on the frame 111. The pressure roller 20 is rotatably supported by the frame 111 via a bearing (not illustrated). The helical compression spring 87 applies a pressure Ft to the fixing flange 45 via a lever 114 and, thus, urges the film unit against the fixing flange 45. The helical compression spring 87 has a lower end 87*a* fixed to one end of the lever 114 and an upper end 87*b* fixed to a spring support portion 93. The helical compression spring 87 is disposed immediately above the fixing flange 45 and the pressure roller 20. The spring support portion 93 is fixed to the frame 111 and causes the helical compression spring to have a specified height so that the pressure of the helical compression spring 87 is maintained at a predetermined pressure. According to the present exemplary embodiment, the helical compression spring 87 has a free height of 35 mm and a specified height of 27 mm. To release the pressure, the lever 114 is rotated about a turning center 111*b* provided in the frame 111 using a cam member 95. In addition, according to the pressure configuration of the present exemplary embodiment, the pressure Fs of the helical compression spring 87 has substantially the same direction and magnitude as the pressure Ft. Accordingly, a force equivalent to the pressure Fs is applied to the heater holder 41 and the film 10 via the fixing flange 45.

Figure 21A:
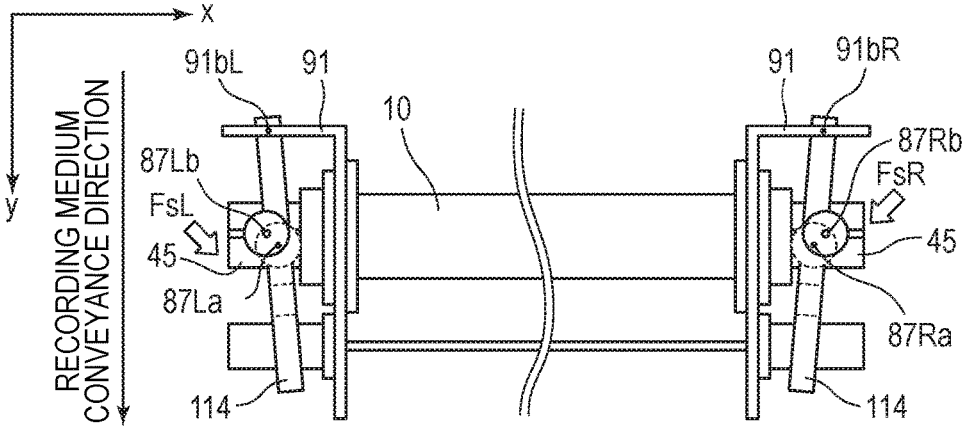
FIGS. 21A and 21B are schematic illustrations of the fixing device according to the third exemplary embodiment.
Figure 21B:
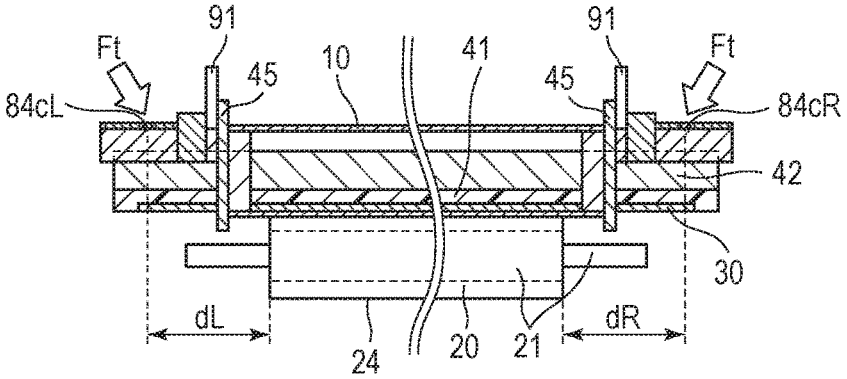

According to the present exemplary embodiment, the winding direction of a helical compression spring 87R is opposite to the winding direction of a helical compression spring 87L. In addition, the position of the winding end of the helical compression spring 87R is substantially symmetrical to the position of the winding end of the helical compression spring 87L with respect to the transverse plane in the middle of the film 10 in the longitudinal direction. In FIGS. 21A and 21B, the helical compression spring 87R is a right-handed helical compression spring, and the helical compression spring 87L is a left-handed helical compression spring.

FIG. 21A is a schematic illustration of the fixing device 72 as viewed from above in a direction perpendicular to a nip surface. FIG. 21B is a schematic illustration of the fixing device 72 as viewed from the downstream side in the recording medium conveyance direction. In FIG. 21A, one of the axes of the pressure roller 20 that defines the right direction as a positive direction is referred to as an "x-axis", and an axis that is parallel to the nip surface and that extends in the recording medium conveyance direction is referred to as a "y-axis".

According to the present exemplary embodiment, when the helical compression spring 87 is compressed and thus, the pressure is generated, the lever 114 moves in a direction so that the bend of the helical compression spring 87 is released. Since the winding directions of the helical compression spring 87R and the helical compression spring 87L are opposite to each other and, in addition, the positions of the winding ends are located so as to be substantially symmetrical, the directions in which the levers 114 move to reduce the bends are symmetrical with respect to the transverse plane in the middle of the film 10 in the longitudinal direction. Accordingly, as illustrated in FIG. 21A, the point 84*c* of application of the pressure Ft is shifted toward the middle of the film 10 in the longitudinal direction of the film 10.

In addition, the slope of the central axis of the helical compression spring 87R is symmetrical to the slope of the central axis of the helical compression spring 87L with respect to the transverse plane in the middle of the film 10 in the longitudinal direction. Similarly, a pressure vector FsR of the helical compression spring 87R is symmetrical to a pressure vector FsL of the helical compression spring 87L with respect to the transverse plane in the middle of the film 10 in the longitudinal direction.

For ease of understanding of the effect of the present exemplary embodiment, the pressure configuration of a comparative example is described below. In the comparative example, the helical compression spring 87R and the helical compression spring 87L are of the same type. Accordingly, the winding directions of the helical compression spring 87R and the helical compression spring 87L are the same. In addition, the helical compression spring 87R and the helical compression spring 87L are disposed so that the position of the winding end of the helical compression spring 87R has the same phase as the winding end of the helical compression spring 87L, or the position of the winding end of the helical compression spring 87R has the same phase as the winding end of the helical compression spring 87L if the helical compression spring 87L is rotated about the axis by 180°. In Comparative example 3 described below, the helical compression spring 87R and the helical compression spring 87L are disposed so that the position of the winding end of the helical compression spring 87R has the same phase as the position of the winding end of the helical compression spring 87L. In contrast, in Comparative example 4 described below, the helical compression spring 87R and the helical compression spring 87L are disposed so that the position of the winding end of the helical compression spring 87R has the same phase as the winding end of the helical compression spring 87L if the helical compression spring 87L is rotated about the axis by 180°.

Figure 22A:
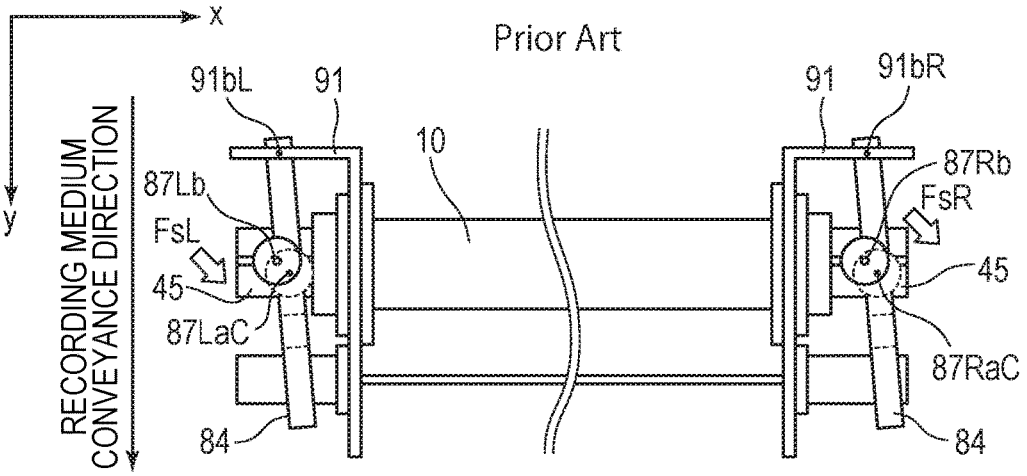
FIG. 22A Prior Art
FIGS. 22A and 22B are schematic illustrations of a fixing device according to Comparative Example 3.
Figure 22B:
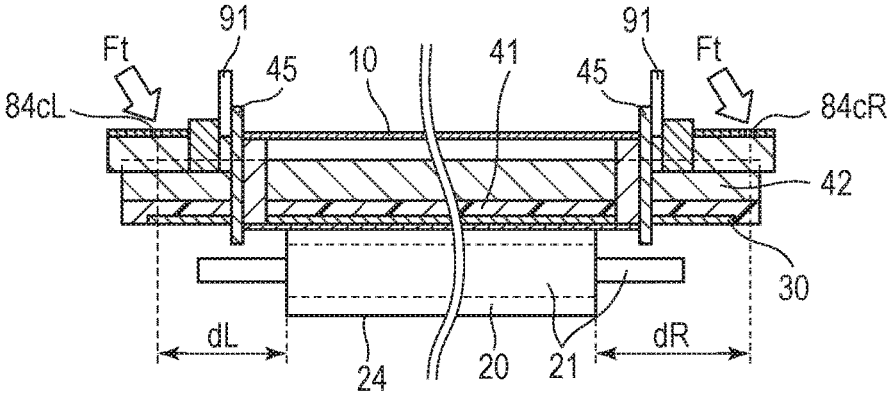
FIG. 22B Prior Art

Comparative example 3 is described below. FIG. 22A is a schematic illustration of the fixing device 72 as viewed from above in a direction perpendicular to a nip surface according to Comparative example 3. FIG. 22B is a schematic illustration of the fixing device 72 as viewed from the downstream side in the recording medium conveyance direction. The directions in which the levers 84 move in order to straighten out the bends of the helical compression springs 87 are the same. Accordingly, as illustrated in FIG. 22A, the point 84*c* of application of the pressure Ft is shifted in the longitudinal direction of the film 10. At that time, a distance dL between the point 84*c*L of application of the pressure Ft applied to the left film guide 45 and the left nip end is shorter than a distance dR between the point 84*c*R of application of the pressure Ft applied to the right film guide 45 and the right nip end. Thus, the surface pressure on the left side of the nip is low, and the surface pressure on the right side of the nip is high. That is, the surface pressures on the right side and the left side in the nip differ from each other. Accordingly, the fixability on the left side in the longitudinal direction tends to be worse than the fixability on the right side in the longitudinal direction.

Figure 23A:
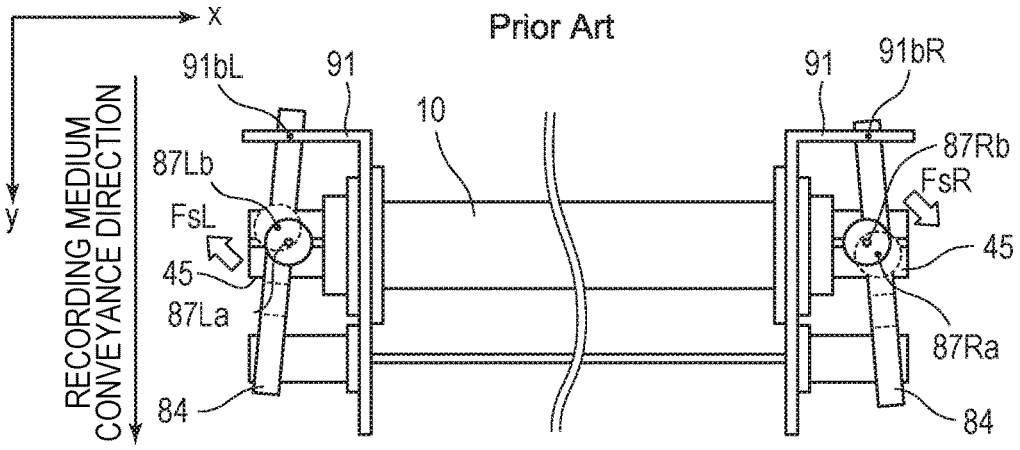
FIG. 23A Prior Art
FIGS. 23A and 23B are schematic illustrations of a fixing device according to Comparative Example 4.
Figure 23B:
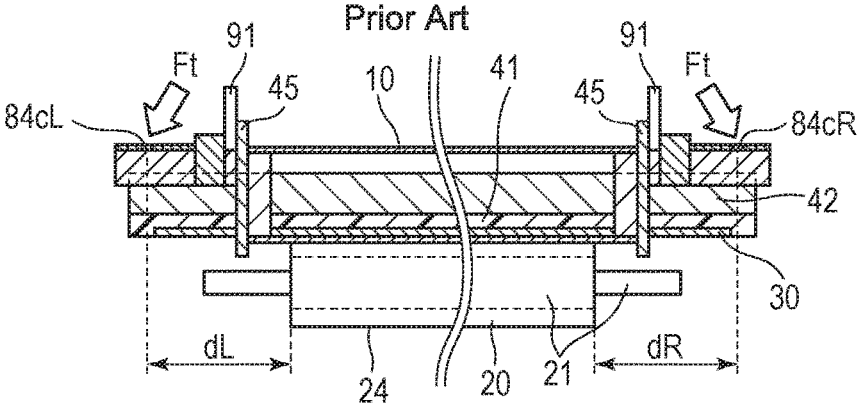
FIG. 23B Prior Art

FIG. 23A is a schematic illustration of the fixing device 72 as viewed from above in a direction perpendicular to the nip surface according to Comparative example 4. FIG. 23B is a schematic illustration of the fixing device 72 as viewed from the downstream side in the recording medium conveyance direction.

Figure 26:
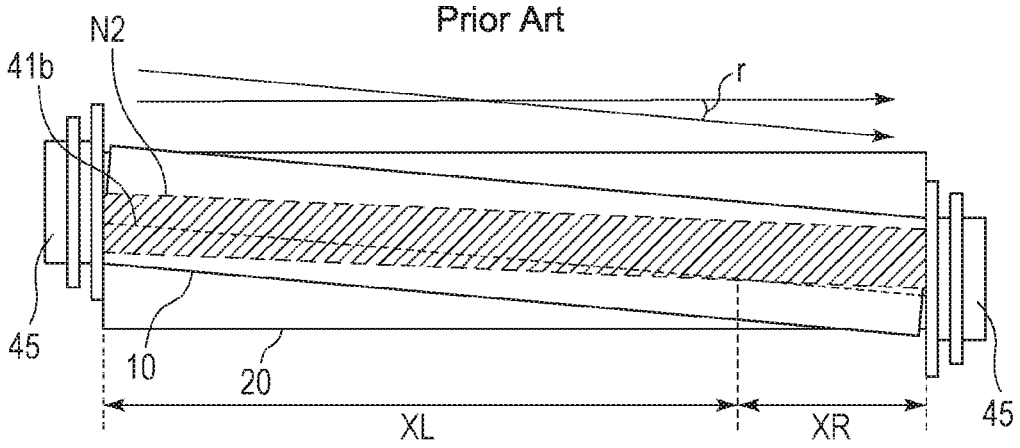
FIG. 26 Prior Art
FIG. 26 illustrates an intersect angle of a fixing device according to a comparative example.

The directions in which the helical compression springs 87 move the levers 84 to straighten out the bends thereof are opposed 180° from each other. Accordingly, the positions are determined as illustrated in FIG. 23A. According to the present comparative example, the problem is that an intersect angle is formed between the generatrix direction of the film 10 and the axial direction of the pressure roller 20. The pressure Fs of the helical compression spring 87 has substantially the same direction and magnitude as the pressure Ft. Accordingly, a force equivalent to the pressure Fs is applied to the heater holder 41 and the film 10 via the fixing flange 45. Since the y-axis component of the pressure vector FsR of the helical compression spring 87R is positive and the v-axis component of the pressure vector FsL of the helical compression spring 87*l* is negative, a force to attempt to rotate in the clockwise direction in FIG. 23A is exerted on the heater holder 41 and the film 10. Thus, the heater holder 41 and the film 10 rotate by a value equivalent to a play of the fixing flange 45. Consequently, as illustrated in FIG. 26, an intersect angle is formed between the generatrix direction of the film 10 and the axial direction of the pressure roller 20. As a result, a range XR where the protrusion 41*b* is not present in the fixing nip N2 is formed on the right side in the longitudinal direction. In a range XL where the protrusion 41*b* of the heater holder 41 is present in the fixing nip N2, the protrusion 41*b* crushes the toner particles on the recording medium that are melted in the inner nip N3 so as to improve the fixability and the gloss. However, in the range XR, the effect of the protrusion 41*b* to crush the toner particles on the recording medium that are melted in the inner nip N3 and improve the fixability and the gloss cannot be obtained. Accordingly, the difference in fixability and the difference in gloss between the range XL and the range XR occur. Consequently, the difference in fixability and the difference in gloss between the middle portion and each of the right and left portions of the image easily occur.

According to the present exemplary embodiment, the point 84*c* of application of the pressure Ft is shifted so as to be close to the middle of the film 10 in the longitudinal direction of the film 10. However, the distance dL between the point 84*c*L of application of the pressure Ft applied to the left film guide 45 and the left nip end is the same as the distance dR between the point 84*c*R of application of the pressure Ft applied to the right film guide 45 and the right nip end. In addition, the center 87*a*C of the lower end, which is the point of effort of the pressure Fs, is shifted in the recording medium conveyance direction. However, the distance between the center 87LaC of the lower end, which is the point of effort of the left pressure Fs and the turning center 91*b*L is the same as the distance between the center 87RaC of the lower end, which is the point of effort of the right pressure Fs, and the turning center 91*b*R. Thus, the moment arms on the right and left sides are the same. As a result, according to the configuration of the present exemplary embodiment, the difference in pressure between right and left is less likely to occur.

According to the present exemplary embodiment, the y-axis component of the pressure vector FsR of the helical compression spring 87R and the y-axis component of the pressure vector FsL of the helical compression spring 87L have the same sign and, thus, the same direction. Accordingly, a force that rotates the heater holder 41 and the film 10 is negligibly generated. Consequently, an intersect angle is negligibly formed between the longitudinal axis of the film 10 and the longitudinal axis of the pressure roller 20. As described above, according to the present exemplary embodiment, uneven fixability and uneven gloss are less likely to occur in the image.

The result of comparison of the above-described Comparative examples 3 and 4 and the present exemplary embodiment in terms of the difference in fixability along the length of an image is given in Table 3. In addition, the result of comparison of Comparative examples 3 and 4 and the present exemplary embodiment in terms of the difference in gloss along the length of an image is given in Table 4.

TABLE 3

| Fixability Evaluation | Position 30 mm from Left Edge of Recording Medium | Middle of Recording Medium | Position 30 mm from Right Edge of Recording Medium | Difference in Fixability in Image |
|---|---|---|---|---|
| Comparative Example 3 | Excellent | Excellent | poor | YES |
| Comparative Example 4 | Excellent | Excellent | poor | YES |
| Present Embodiment | Excellent | Excellent | Excellent | NO |

TABLE 4

| Gloss Evaluation | Position 30 mm from Left Edge of Recording Medium | Middle of Recording Medium | Position 30 mm from Right Edge of Recording Medium | Difference in Gloss in Image |
|---|---|---|---|---|
| Comparative Example 3 | Excellent | Excellent | Fair | YES |
| Comparative Example 4 | Fair | Excellent | Poor | YES |
| Present Embodiment | Excellent | Excellent | Excellent | NO |

The evaluation method is the same as that described in the second exemplary embodiment. The results in Tables 3 and 4 indicate that the configuration according to the present exemplary embodiment reduces the difference in fixability and the difference in gloss throughout an image more than the configurations of Comparative examples 3 and 4.

As described above, according to the present exemplary embodiment, the fixing device having a configuration that negligibly generates the difference in fixability and gloss throughout an image. In addition, since the difference in the surface pressure in the nip between right and left can be reduced, the difference in conveyance force between both the ends is less likely to occur and, thus, the rate of occurrence of paper wrinkling can be reduced. Furthermore, by employing the configuration according to the present exemplary embodiment, the difference in the surface pressure in the nip can be reduced and, thus, the lifetime of the fixing device can be increased.

Note that the effect of the pressure mechanism of the fixing device according to the present exemplary embodiment to improve the sheet transportability can be applied to recording medium conveyance devices that convey a recording medium using a nip portion formed by two rotary members (first and second rotary members) in tight contact with each other, in addition to fixing devices.

As another example of application, the lever 114 and the cam member 95 (i.e., a pressure release mechanism) may be removed from the configuration of the present exemplary embodiment. Even in such a case, like the present exemplary embodiment, the winding direction of the helical compression spring 87R is set so as to be opposite to the winding direction of the helical compression spring 87L. In addition, the position of the winding end of the helical compression spring 87R is set so as to be substantially symmetrical to the position of the winding end of the helical compression spring 87L. In this manner, the fixing device that negligibly generates the difference in fixability and the difference in gloss throughout an image can be provided.

In the configuration without the lever 114 and the cam member 95 (i.e., a pressure release mechanism), the helical compression spring 87 directly applies pressure on the fixing flange 45 without using the lever 114. In such a case, in the configuration of Comparative example 3, the fixing flange 45 moves in the longitudinal direction of the film by a value equivalent to a play given by assembling of the fixing flange 45. Accordingly, the point 84*c* of application of the pressure Ft is shifted in the longitudinal direction of the film and, thus, the difference between the distance dL and the distance dR is generated. Consequently, the difference in the surface pressure in the nip between right and left occurs and, thus, the difference in fixability and the difference in gloss between right and left occur. In the configuration of Comparative example 4, an intersect angle is formed between the longitudinal axis of the film 10 and the longitudinal axis of the pressure roller 20. Accordingly, the difference in fixability and the difference in gloss between right and left occur. As described above, in the configurations of the comparative examples, the difference in fixability and the difference in gloss throughout an image (i.e., uneven fixability and uneven gloss) are generated. In contrast, in configurations similar to the configuration according to the present exemplary embodiment, since the fixing flanges 45 move in a right-left symmetrical manner. Thus, the difference in the surface pressure is less likely to occur. In this manner, the difference in fixability and the difference in gloss between right and left can be reduced.

Fourth Exemplary Embodiment

An image forming apparatus according to the fourth exemplary embodiment is described below. The image forming apparatus includes the recording medium conveyance device of the present invention. Note that according to the present exemplary embodiment, description of constituent elements that are similar to those of the second exemplary embodiment is not repeated. Unlike the second exemplary embodiment, the spring support portion 93 is replaced with an upper end supporting table 130, and the position of the upper end supporting table 130 is fixed by a regulating member 94.

According to the second exemplary embodiment, by regulating the height of the helical compression spring 87 to a specified height, a predetermined pressure is obtained. However, a variation of the spring constant and a variation of the free height occur among helical compression springs. Accordingly, even when the spring lengths are regulated so as to be specified heights, a difference in pressure between right and left occurs, in reality. According to the present exemplary embodiment, by addressing the above-described issue, a configuration capable of adjusting the pressure to a predetermined pressure can be provided.

Figure 24:
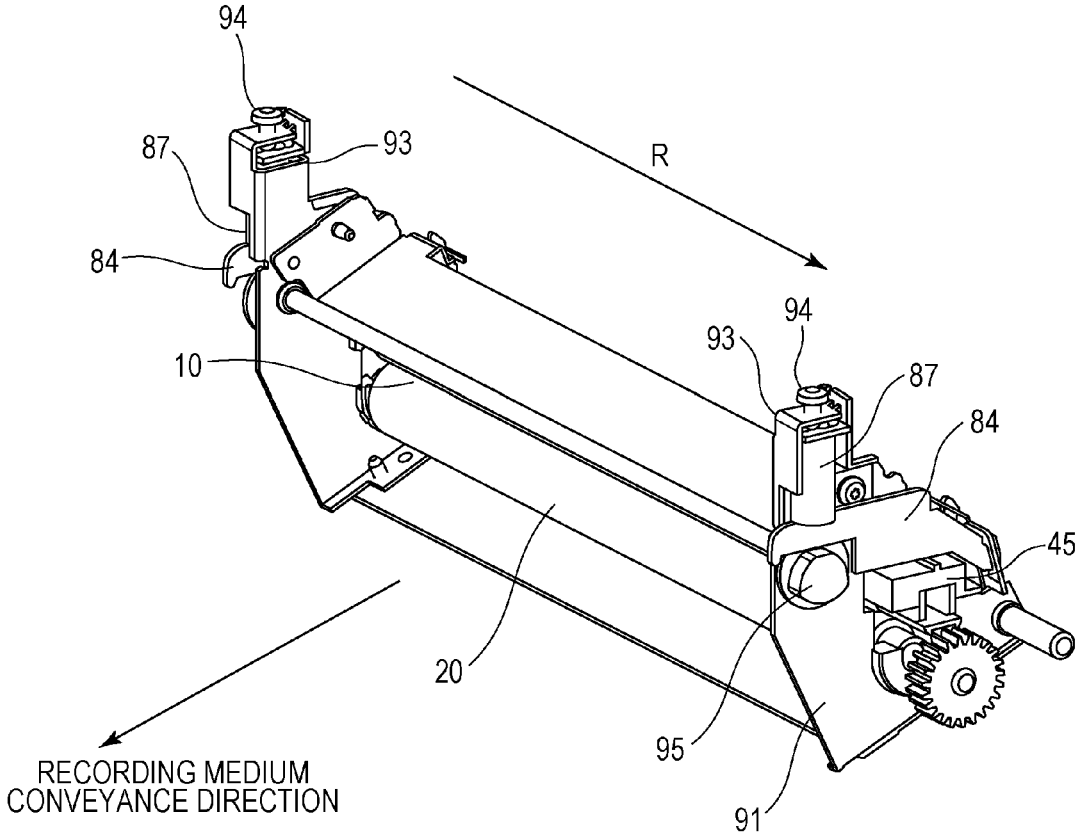
FIG. 24 is a perspective view of a fixing device according to a fourth exemplary embodiment.
Figure 25:
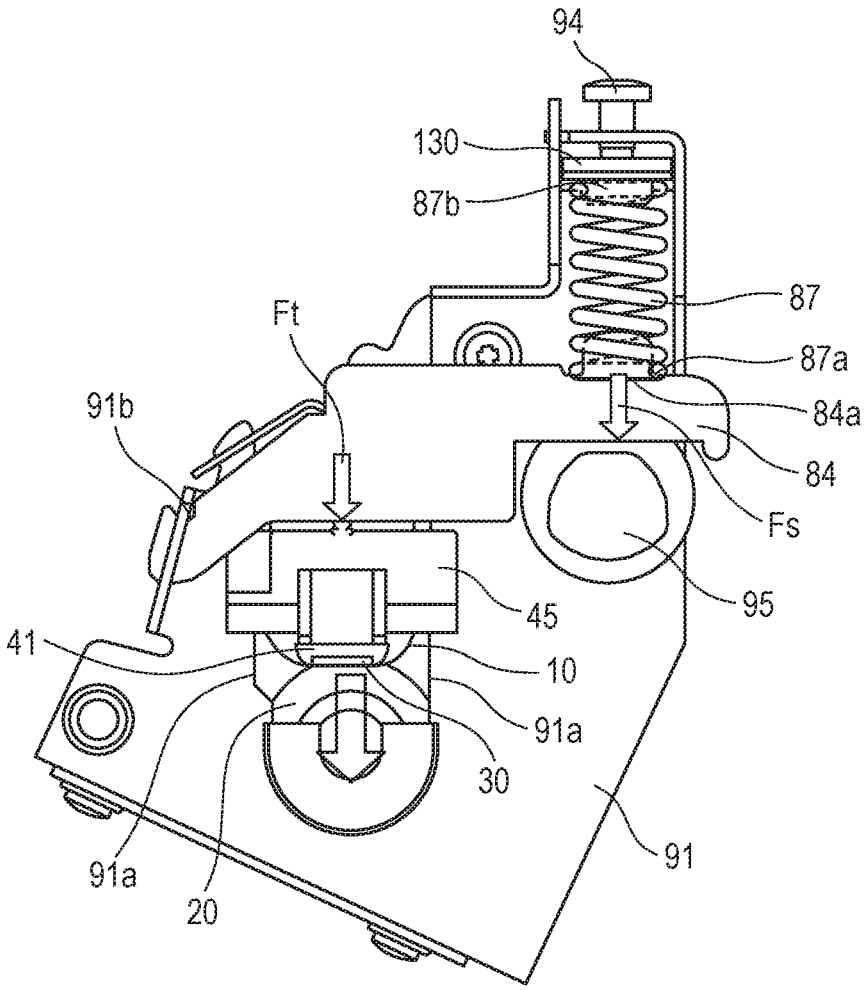
FIG. 25 is a side view of the fixing device according to the fourth exemplary embodiment.

The pressure mechanism that applies the pressure Ft is described below with reference to FIGS. 24 and 25. FIG. 24 is a perspective view of a fixing device. FIG. 25 is a side view of the fixing device as viewed in a direction of an arrow R in FIG. 24.

The upper end supporting table 130 is a spring terminal supporting member that fixedly supports the upper end 87*b* of the helical compression spring 87. The upper end supporting table 130 is movable in a direction in which the helical compression spring 87 is compressed. In addition, the movement of the upper end supporting table 130 is regulated in a direction in which the helical compression spring 87 is compressed by the regulating member 94.

Adjustment of the pressure is performed in the following manner. That is, the upper end supporting table 130 is moved by a jig (not illustrated) so that the pressure of the helical compression spring 87 is maintained at predetermined pressure. At that time, the pressure of the helical compression spring 87 is measured by a pressure meter attached to the jig via the upper end supporting table 130. The upper end supporting table 130 is fixed at a position at which the measured value of the pressure meter is the predetermined pressure by the regulating member 94. In this manner, the position of the upper end supporting table 130 in a pressure direction of the helical compression spring 87 is regulated relative to the frame 91 and, thus, the predetermined pressure is obtained. According to the present exemplary embodiment, the regulating member 94 is formed from a screw. The screw is screwed in the pressure direction of the helical compression spring 87, and the top end of the screw supports the upper end supporting table 130. In this manner, the position of the upper end supporting table 130 is regulated.

According to the present exemplary embodiment, the pressure mechanism is supported by the top end of the screw serving as the regulating member 94, and the position of the upper end supporting table 130 is regulated. Accordingly, the upper end supporting table 130 is easily inclined. As described above in the second exemplary embodiment, to straighten out the bend of the helical compression spring 87 occurring when the helical compression spring 87 is compressed, the helical compression spring 87 moves the lever 84 and, thus, is inclined from the direction of the pressure Ft. Consequently, the spring end surface at the upper end 87*b* is inclined in a direction in which the amount of compression of the helical compression spring 87 decreases and the inclination of the helical compression spring 87 from the direction of the pressure Ft increases. In this manner, the lever 84 is moved.

Accordingly, as in the second exemplary embodiment, in the present exemplary embodiment, the helical compression spring 87R having a winding direction that is opposite to the winding direction of the helical compression spring 87L is employed. In addition, the position of the winding end of the helical compression spring 87R is set so as to be substantially symmetrical to the position of the winding end of the helical compression spring 87L. As a result, an effect that is the same as the effect of the second exemplary embodiment can be obtained. That is, the difference in the surface pressure in the nip between right and left is reduced, and the difference in fixability and the difference in gloss throughout an image can be reduced.

By employing the above-described configuration, a fixing device that negligibly generates the difference in fixability and the difference in gloss throughout an image can be provided.

In addition, by employing the configuration according to the present exemplary embodiment, the difference in the surface pressure in the nip between right and left can be reduced. Thus, the difference in conveyance force between both the ends is less likely to occur. As a result, the rate of occurrence of paper wrinkling can be reduced.

Furthermore, by employing the configuration according to the present exemplary embodiment, the difference in the surface pressure in the nip can be reduced and, thus, the lifetime of the fixing device can be increased.

Note that according to the present exemplary embodiment, even when like the third exemplary embodiment, the position of the helical compression spring is changed, the same effect can be obtained.

The effect to increase the recording medium conveyance performance in the fixing nip N2 of the pressure mechanism of the fixing device according to the present exemplary embodiment can be applied to recording medium conveyance devices that convey a recording medium using a nip portion formed by two rotary members in tight contact with each other, in addition to fixing devices.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-015749 filed Jan. 29, 2015 and No. 2015-074301 filed Mar. 31, 2015, which are hereby incorporated by reference herein in their entirety.

What is claimed is:

1. A fixing device for fixing a toner image onto a recording medium by conveying and heating the recording medium on which the toner image is formed at a nip portion, comprising:

a first fixing member;

a second fixing member configured to form the nip portion together with the first fixing member;

a frame configured to support the second fixing member; and a pair of urging mechanisms provided on either end of the first fixing member in a longitudinal direction of the first fixing member, the pair of urging mechanisms urging the first fixing member against the second fixing member, wherein each of the pair of urging mechanisms includes a lever movable with respect to the frame in an urging direction in which the first fixing member is urged, and a helical compression spring disposed in a compression state between a first spring support portion of the lever and a second spring support portion of the frame, the spring including a first winding end portion and a second winding end portion opposite to the first winding end portion in a compression direction of the spring, wherein the first fixing member is urged against the second fixing member via the lever by an elastic force of the spring, and wherein at least one of the first spring support portion and the second spring support portion includes, a protruding portion protruding toward the spring and inserted into an inner diameter side of the spring, and a supporting surface supporting the first winding end portion of the spring, the supporting surface being provided outside the protruding portion in a radial direction of the spring, and wherein the supporting surface includes a first supporting area and a second supporting area closer to the second winding end portion of the spring_ in the urging direction than the first supporting area, a portion of the first winding end portion of the spring with which the second supporting area of the supporting surface contacts is located downstream of a portion of the first winding end portion of the spring with which the first supporting area of the supporting surface contacts, in a winding direction of the spring from the first winding end portion to the second winding end portion.

2. The fixing device according to claim 1, wherein the first supporting area and the second supporting area are symmetrical with respect to an axial center of the spring when viewed in the axial direction.

3. The fixing device according to claim 1, wherein the first spring support portion includes the first supporting area and the second supporting area.

4. The fixing device according to claim 1, wherein the lever is formed from a plate member, and each of the first supporting area and the second supporting area is formed in an edge surface of the plate member.

5. The fixing device according to claim 1, wherein the first winding end portion of the spring has a closed-end shape.

6. The fixing device according to claim 1, wherein the first fixing member includes a cylindrical film and a heater configured to heat the film.

7. The fixing device according to claim 6, wherein the second fixing member is a roller, and the heater is in contact with an inner peripheral surface of the film to form the nip portion together with the roller via the film.

8. The fixing device according to claim 1, wherein the first supporting area of the supporting surface is located at a position different from the second supporting area of the supporting surface in the winding direction of the spring, when the first supporting area and the second supporting area of the supporting surface are viewed in the urging direction.

9. A fixing device for fixing a toner image onto a recording medium by conveying and heating the recording medium on which the toner image is formed at a nip portion, comprising:

a first fixing member;

a second fixing member configured to form the nip portion together with the first fixing member;

a frame configured to support the second fixing member; and a pair of urging mechanisms provided on either end of the first fixing member in a longitudinal direction of the first fixing member, the pair of urging mechanisms urging the first fixing member against the second fixing member, wherein each of the pair of urging mechanisms includes a lever movable with respect to the frame _in an urging direction in which the first fixing member is urged and a helical compression spring disposed in a compression state between the lever and the frame, wherein the first fixing member is urged against the second fixing member via the lever by an elastic force of the spring, and wherein a winding direction of the spring included in one of the pair of urging mechanisms is opposite to a winding direction of the spring included in the other of the pair of urging mechanisms.

10. The fixing device according to claim 9, wherein the first fixing member includes a cylindrical film and a heater configured to heat the film.

11. The fixing device according to claim 10, wherein the second fixing member is a roller, and the heater is in contact with an inner peripheral surface of the film to form the nip portion together with the roller via the film.

12. The fixing device according to claim 9, wherein positions of winding ends of the spring, in the winding direction of the spring, included in one of the pair of urging mechanisms are symmetrical to positions of winding ends of the spring, in the winding direction of the spring, included in the other of the pair of urging mechanisms with respect to a transverse plane in a longitudinal center of the first fixing member.

13. A fixing device for fixing a toner image onto a recording medium by conveying and heating the recording medium on which the toner image is formed at a nip portion, comprising:

a first fixing member;

a second fixing member configured to form the nip portion together with the first fixing member;

a frame configured to support the second fixing member; and a pair of urging mechanisms provided on either end of the first fixing member in a longitudinal direction of the first fixing member, the pair of urging mechanisms urging the first fixing member against the second fixing member, wherein each of the pair of urging mechanisms includes a lever movable with respect to the frame in an urging direction in which the first fixing member is urged and a helical compression spring disposed in a compression state between a first spring support portion of the lever and a second spring support portion of the frame, the spring including a first winding end portion and a second winding end portion opposite to the first winding end portion in a compression direction of the spring, wherein the first fixing member is urged against the second fixing member via the lever by an elastic force of the spring, and wherein at least one of the first spring support portion and the second spring support portion includes a protruding portion protruding toward the spring and inserted into an inner diameter side of the spring and a supporting surface supporting the first winding end portion of the spring, the supporting surface being provided outside the protruding portion in a radial direction of the spring and being configured to approach to the second winding end portion of the spring as it extends in a winding direction of the spring from the first winding end portion to the second winding end portion.

* * * * *